US011114748B2

(12) United States Patent
Yarga et al.

(10) Patent No.: US 11,114,748 B2
(45) Date of Patent: Sep. 7, 2021

(54) FLEXIBLE PRINTED CIRCUIT STRUCTURES FOR ELECTRONIC DEVICE ANTENNAS

(71) Applicant: Apple Inc., Cupertino, CA (US)

(72) Inventors: Salih Yarga, Sunnyvale, CA (US); Soroush Akbarzadeh, San Jose, CA (US); Jonathan M. Lee, Fremont, CA (US); Gareth L. Rose, San Francisco, CA (US); Javier Gomez Tagle, San Jose, CA (US); Joshua G. Nickel, San Jose, CA (US); Mattia Pascolini, San Francisco, CA (US); Ian A. Spraggs, San Francisco, CA (US); Daniel W. Jarvis, Sunnyvale, CA (US); Sunitha Seshadri, Fremont, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/563,760

(22) Filed: Sep. 6, 2019

(65) Prior Publication Data

US 2021/0075090 A1 Mar. 11, 2021

(51) Int. Cl.
*H01Q 1/24* (2006.01)
*H01Q 5/30* (2015.01)
(Continued)

(52) U.S. Cl.
CPC ..... *H01Q 1/243* (2013.01); *H01Q 1/085* (2013.01); *H01Q 1/241* (2013.01); *H01Q 1/38* (2013.01); *H01Q 5/25* (2015.01); *H01Q 5/30* (2015.01)

(58) Field of Classification Search
CPC ..... H01Q 1/243; H01Q 9/42; H01Q 1/38; H01Q 9/0421; H01Q 5/328; H01Q 13/103;
(Continued)

(56) References Cited

U.S. PATENT DOCUMENTS 8,059,046 B2 11/2011 Nysen et al.
9,331,391 B2 5/2016 Chien et al.
(Continued)

FOREIGN PATENT DOCUMENTS

WO 2019086866 A1 5/2019
WO 2019194805 A1 10/2019

*Primary Examiner* — Vibol Tan
(74) *Attorney, Agent, or Firm* — Treyz Law Group, P.C.; Michael H. Lyons

(57) ABSTRACT

An electronic device may have peripheral conductive housing structures divided into first and second segments. First and second antennas may be formed from the segments and may be fed using a flexible printed circuit structure. The structure may include a first substrate attached to the first segment, a second substrate soldered to the first substrate and attached to the second segment, and a third substrate soldered to the second substrate. Third and fourth antennas may be formed on the first substrate whereas fifth and sixth antennas are be formed on the second substrate. The second substrate may be folded and may have a lateral area oriented perpendicular to the third, fourth, fifth, and sixth antennas. Modularly forming the structure in this way may maximize the flexibility with which the structure can accommodate other components, thereby minimizing the space consumption associated with mounting and feeding the antennas without sacrificing wireless performance.

20 Claims, 10 Drawing Sheets

(51) Int. Cl.

| | |
|---|---|
| ***H01Q 1/38*** | (2006.01) |
| ***H01Q 5/25*** | (2015.01) |
| ***H01Q 1/08*** | (2006.01) |

(58) Field of Classification Search
CPC .... H01Q 1/2266; H01Q 1/2291; H01Q 1/241; H01Q 5/35; H01Q 5/25; H01Q 5/30; H01Q 5/357; H01Q 9/0414; H01Q 1/526; H01Q 21/062; H01Q 5/335; H01Q 9/0407; H01Q 9/285; H01Q 1/24; H01Q 1/242; H01Q 23/00; H01Q 5/378; H01Q 5/50; H01Q 9/04; H01Q 11/105; H01Q 13/106; H01Q 1/085; H01Q 7/005; H01Q 9/0435; H01Q 9/065; H05K 1/028; H05K 1/189; H05K 1/0243; H05K 1/0277; H05K 1/144; H04B 7/0413; H04B 7/04
See application file for complete search history.

(56) References Cited

U.S. PATENT DOCUMENTS

| | | | | |
|---|---|---|---|---|
| 9,502,752 | B2 * | 11/2016 | Darnell | H01Q 1/48 |
| 9,564,679 | B2 | 2/2017 | Rho et al. | |
| 9,705,180 | B2 * | 7/2017 | Darnell | H01Q 1/243 |
| 9,972,892 | B2 * | 5/2018 | Noori | H01Q 1/2266 |
| 10,305,172 | B2 * | 5/2019 | Noori | H01Q 1/243 |
| 10,324,327 | B2 | 6/2019 | Lim et al. | |
| 10,367,570 | B2 | 7/2019 | Zhou et al. | |
| 10,418,687 | B2 * | 9/2019 | Mow | H01Q 21/065 |
| 2013/0257659 | A1 * | 10/2013 | Darnell | H05K 1/181 343/702 |
| 2018/0026341 | A1 * | 1/2018 | Mow | H04B 10/90 343/702 |
| 2018/0083344 | A1 * | 3/2018 | Han | H01Q 13/106 |
| 2018/0090816 | A1 * | 3/2018 | Mow | H01Q 9/0421 |
| 2018/0294576 | A1 | 10/2018 | Niakan et al. | |
| 2019/0067821 | A1 | 2/2019 | Kim et al. | |
| 2019/0097317 | A1 | 3/2019 | Di Nallo et al. | |
| 2019/0260127 | A1 | 8/2019 | Shi et al. | |

* cited by examiner

FLEXIBLE PRINTED CIRCUIT STRUCTURES FOR ELECTRONIC DEVICE ANTENNAS

BACKGROUND

This relates generally to electronic devices and, more particularly, to electronic devices with wireless communications circuitry.

Electronic devices are often provided with wireless communications capabilities. To satisfy consumer demand for small form factor electronic devices, manufacturers are continually striving to implement wireless circuitry such as antennas using compact structures.

At the same time, more and more antennas are being used in electronic devices to cover a greater number of communications bands at different frequencies. In practice, it can be difficult to feed radio-frequency signals for multiple antennas in an electronic device with satisfactory isolation, particularly given the size constraints imposed on the electronic device.

It would therefore be desirable to be able to provide improved wireless circuitry for electronic devices.

SUMMARY

An electronic device may be provided with wireless circuitry and peripheral conductive housing structures. A dielectric-filled gap may divide the peripheral conductive housing structures into first and second segments. The wireless circuitry may include a first antenna having a resonating element arm formed from the first segment and a second antenna having a resonating element arm formed from the second segment.

The first and second antennas may be fed using a flexible printed circuit structure. The flexible printed circuit structure may include a first flexible printed circuit substrate attached to the first segment, a second flexible printed circuit substrate surface-mounted (e.g., soldered) to the first flexible printed circuit substrate and attached to the second segment, and a third flexible printed circuit substrate surface-mounted to the second flexible printed circuit substrate. A first radio-frequency transmission line path for feeding the first antenna may be formed on the first and second flexible printed circuit substrates. A second radio-frequency transmission line path for feeding the second antenna may be formed on the second flexible printed circuit substrate. A board-to-board connector may be mounted to the second flexible printed circuit substrate.

Third and fourth antennas may be formed on the first flexible printed circuit substrate whereas fifth and sixth antennas are be formed on the second flexible printed circuit substrate. Radio-frequency transmission line paths for the third, fourth, fifth, and sixth antennas may be formed on the flexible printed circuit structure. The fourth, fifth, and sixth antennas may form a triplet of antennas that convey radio-frequency signals in an ultra-wideband communications band. The third antenna may receive radio-frequency signals in the ultra-wideband communications band and may transmit and receive radio-frequency signals in a non-ultrawideband communications band.

The first flexible printed circuit substrate may include at least three bends about orthogonal axes. The lateral area of the second flexible printed circuit substrate may be oriented perpendicular to the third, fourth, fifth, and sixth antennas. The second flexible printed circuit substrate may include at least two bends about parallel axes. The third flexible printed circuit substrate may include at least one bend about an axis perpendicular to the parallel axes associated with the second flexible printed circuit substrate. The second flexible printed circuit substrate may be wrapped around a camera module or other device components. The first, second, and third flexible printed circuit substrates may each have thinner portions and thicker portions that are thicker than the thinner portions by different respective step sizes. Modularly forming the flexible printed circuit structure in this way may maximize the flexibility with which the flexible printed circuit structure can accommodate other components within the electronic device, thereby minimizing the space consumption associated with mounting and feeding the antennas without sacrificing radio-frequency performance.

DETAILED DESCRIPTION

Figure 1:
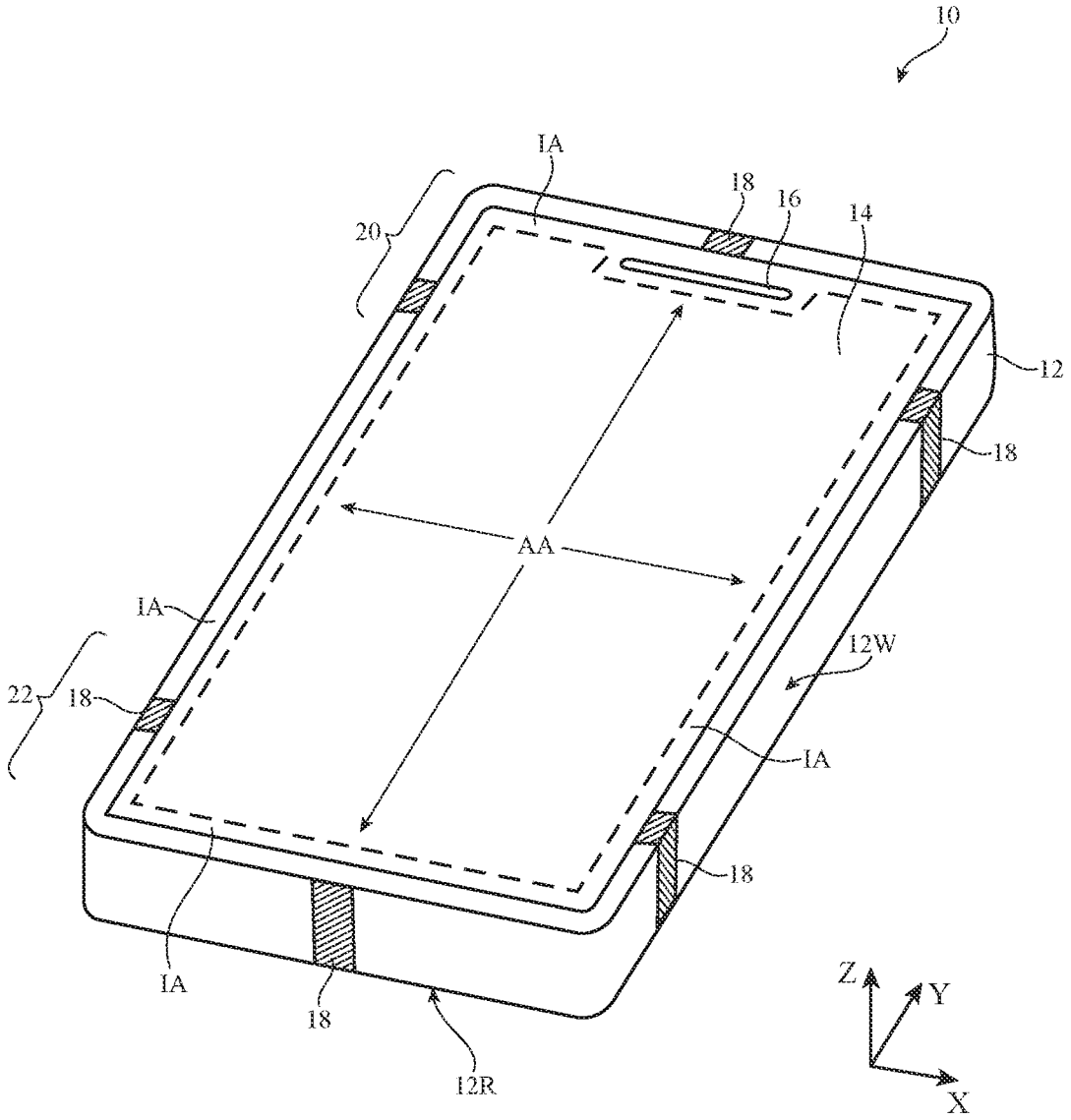
FIG. 1 is a perspective view of an illustrative electronic device in accordance with some embodiments.

Electronic devices such as electronic device 10 of FIG. 1 may be provided with wireless circuitry (sometimes referred to herein as wireless communications circuitry). The wireless circuitry may be used to support wireless communications in multiple wireless communications bands. Communications bands (sometimes referred to herein as frequency bands) handled by the wireless circuitry can include satellite navigation system communications bands, cellular telephone communications bands, wireless local area network communications bands, near-field communications bands, ultra-wideband communications bands, or other wireless communications bands.

The wireless circuitry may include one or more antennas. The antennas of the wireless circuitry can include loop antennas, inverted-F antennas, strip antennas, planar inverted-F antennas, patch antennas, slot antennas, hybrid antennas that include antenna structures of more than one type, or other suitable antennas. Conductive structures for the antennas may, if desired, be formed from conductive electronic device structures.

The conductive electronic device structures may include conductive housing structures. The conductive housing structures may include peripheral structures such as peripheral conductive structures that run around the periphery of the electronic device. The peripheral conductive structures may serve as a bezel for a planar structure such as a display, may serve as sidewall structures for a device housing, may have portions that extend upwards from an integral planar rear housing (e.g., to form vertical planar sidewalls or curved sidewalls), and/or may form other housing structures.

Gaps may be formed in the peripheral conductive structures that divide the peripheral conductive structures into peripheral segments. One or more of the segments may be used in forming one or more antennas for electronic device 10. Antennas may also be formed using an antenna ground plane and/or an antenna resonating element formed from conductive housing structures (e.g., internal and/or external structures, support plate structures, etc.).

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, a wireless access point, a wireless base station, an electronic device incorporated into a kiosk, building, or vehicle, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a substantially planar housing wall such as rear housing wall 12R (e.g., a planar housing wall). Rear housing wall 12R may have slots that pass entirely through the rear housing wall and that therefore separate portions of housing 12 from each other. Rear housing wall 12R may include conductive portions and/or dielectric portions. If desired, rear housing wall 12R may include a planar metal layer covered by a thin layer or coating of dielectric such as glass, plastic, sapphire, or ceramic. Housing 12 may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Housing 12 may include peripheral housing structures such as peripheral structures 12W. Peripheral structures 12W and conductive portions of rear housing wall 12R may sometimes be referred to herein collectively as conductive structures of housing 12. Peripheral structures 12W may run around the periphery of device 10 and display 14. In configurations in which device 10 and display 14 have a rectangular shape with four edges, peripheral structures 12W may be implemented using peripheral housing structures that have a rectangular ring shape with four corresponding edges and that extend from rear housing wall 12R to the front face of device 10 (as an example). Peripheral structures 12W or part of peripheral structures 12W may serve as a bezel for display 14 (e.g., a cosmetic trim that surrounds all four sides of display 14 and/or that helps hold display 14 to device 10) if desired. Peripheral structures 12W may, if desired, form sidewall structures for device 10 (e.g., by forming a metal band with vertical sidewalls, curved sidewalls, etc.).

Peripheral structures 12W may be formed of a conductive material such as metal and may therefore sometimes be referred to as peripheral conductive housing structures, conductive housing structures, peripheral metal structures, peripheral conductive sidewalls, peripheral conductive sidewall structures, conductive housing sidewalls, peripheral conductive housing sidewalls, sidewalls, sidewall structures, or a peripheral conductive housing member (as examples). Peripheral conductive housing structures 12W may be formed from a metal such as stainless steel, aluminum, or other suitable materials. One, two, or more than two separate structures may be used in forming peripheral conductive housing structures 12W.

It is not necessary for peripheral conductive housing structures 12W to have a uniform cross-section. For example, the top portion of peripheral conductive housing structures 12W may, if desired, have an inwardly protruding lip that helps hold display 14 in place. The bottom portion of peripheral conductive housing structures 12W may also have an enlarged lip (e.g., in the plane of the rear surface of device 10). Peripheral conductive housing structures 12W may have substantially straight vertical sidewalls, may have sidewalls that are curved, or may have other suitable shapes. In some configurations (e.g., when peripheral conductive housing structures 12W serve as a bezel for display 14), peripheral conductive housing structures 12W may run around the lip of housing 12 (i.e., peripheral conductive housing structures 12W may cover only the edge of housing 12 that surrounds display 14 and not the rest of the sidewalls of housing 12).

Rear housing wall 12R may lie in a plane that is parallel to display 14. In configurations for device 10 in which some or all of rear housing wall 12R is formed from metal, it may be desirable to form parts of peripheral conductive housing structures 12W as integral portions of the housing structures forming rear housing wall 12R. For example, rear housing wall 12R of device 10 may include a planar metal structure and portions of peripheral conductive housing structures 12W on the sides of housing 12 may be formed as flat or curved vertically extending integral metal portions of the planar metal structure (e.g., housing structures 12R and 12W may be formed from a continuous piece of metal in a unibody configuration). Housing structures such as these may, if desired, be machined from a block of metal and/or may include multiple metal pieces that are assembled together to form housing 12. Rear housing wall 12R may have one or more, two or more, or three or more portions. Peripheral conductive housing structures 12W and/or conductive portions of rear housing wall 12R may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide peripheral conductive housing structures 12W and/or conductive portions of rear housing wall 12R from view of the user).

Display 14 may have an array of pixels that form an active area AA that displays images for a user of device 10. For example, active area AA may include an array of display pixels. The array of pixels may be formed from liquid crystal display (LCD) components, an array of electrophoretic pixels, an array of plasma display pixels, an array of organic light-emitting diode display pixels or other light-emitting diode pixels, an array of electrowetting display pixels, or display pixels based on other display technologies. If desired, active area AA may include touch sensors such as touch sensor capacitive electrodes, force sensors, or other sensors for gathering a user input.

Display 14 may have an inactive border region that runs along one or more of the edges of active area AA. Inactive area IA may be free of pixels for displaying images and may overlap circuitry and other internal device structures in housing 12. To block these structures from view by a user of device 10, the underside of the display cover layer or other layers in display 14 that overlap inactive area IA may be coated with an opaque masking layer in inactive area IA. The opaque masking layer may have any suitable color.

Display 14 may be protected using a display cover layer such as a layer of transparent glass, clear plastic, transparent ceramic, sapphire, or other transparent crystalline material, or other transparent layer(s). The display cover layer may have a planar shape, a convex curved profile, a shape with planar and curved portions, a layout that includes a planar main area surrounded on one or more edges with a portion that is bent out of the plane of the planar main area, or other suitable shapes. The display cover layer may cover the entire front face of device 10. In another suitable arrangement, the display cover layer may cover substantially all of the front face of device 10 or only a portion of the front face of device 10. Openings may be formed in the display cover layer. For example, an opening may be formed in the display cover layer to accommodate a button. An opening may also be formed in the display cover layer to accommodate ports such as speaker port 16 or a microphone port. Openings may be formed in housing 12 to form communications ports (e.g., an audio jack port, a digital data port, etc.) and/or audio ports for audio components such as a speaker and/or a microphone if desired.

Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a backplate) that spans the walls of housing 12 (i.e., a substantially rectangular sheet formed from one or more metal parts that is welded or otherwise connected between opposing sides of peripheral conductive structures 12W). The backplate may form an exterior rear surface of device 10 or may be covered by layers such as thin cosmetic layers, protective coatings, and/or other coatings that may include dielectric materials such as glass, ceramic, plastic, or other structures that form the exterior surfaces of device 10 and/or serve to hide the backplate from view of the user. Device 10 may also include conductive structures such as printed circuit boards, components mounted on printed circuit boards, and other internal conductive structures. These conductive structures, which may be used in forming a ground plane in device 10, may extend under active area AA of display 14, for example.

In regions 22 and 20, openings may be formed within the conductive structures of device 10 (e.g., between peripheral conductive housing structures 12W and opposing conductive ground structures such as conductive portions of rear housing wall 12R, conductive traces on a printed circuit board, conductive electrical components in display 14, etc.). These openings, which may sometimes be referred to as gaps, may be filled with air, plastic, and/or other dielectrics and may be used in forming slot antenna resonating elements for one or more antennas in device 10, if desired.

Conductive housing structures and other conductive structures in device 10 may serve as a ground plane for the antennas in device 10. The openings in regions 22 and 20 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 22 and 20. If desired, the ground plane that is under active area AA of display 14 and/or other metal structures in device 10 may have portions that extend into parts of the ends of device 10 (e.g., the ground may extend towards the dielectric-filled openings in regions 22 and 20), thereby narrowing the slots in regions 22 and 20.

In general, device 10 may include any suitable number of antennas (e.g., one or more, two or more, three or more, four or more, etc.). The antennas in device 10 may be located at opposing first and second ends of an elongated device housing (e.g., ends at regions 22 and 20 of device 10 of FIG. 1), along one or more edges of a device housing, in the center of a device housing, in other suitable locations, or in one or more of these locations. The arrangement of FIG. 1 is merely illustrative.

Portions of peripheral conductive housing structures 12W may be provided with peripheral gap structures. For example, peripheral conductive housing structures 12W may be provided with one or more gaps such as gaps 18, as shown in FIG. 1. The gaps in peripheral conductive housing structures 12W may be filled with dielectric such as polymer, ceramic, glass, air, other dielectric materials, or combinations of these materials. Gaps 18 may divide peripheral conductive housing structures 12W into one or more peripheral conductive segments. There may be, for example, two peripheral conductive segments in peripheral conductive housing structures 12W (e.g., in an arrangement with two gaps 18), three peripheral conductive segments (e.g., in an arrangement with three gaps 18), four peripheral conductive segments (e.g., in an arrangement with four gaps 18), six peripheral conductive segments (e.g., in an arrangement with six gaps 18), etc. The segments of peripheral conductive housing structures 12W that are formed in this way may form parts of antennas in device 10 if desired.

If desired, openings in housing 12 such as grooves that extend partway or completely through housing 12 may extend across the width of the rear wall of housing 12 and may penetrate through the rear wall of housing 12 to divide the rear wall into different portions. These grooves may also extend into peripheral conductive housing structures 12W and may form antenna slots, gaps 18, and other structures in device 10. Polymer or other dielectric may fill these grooves and other housing openings. In some situations, housing openings that form antenna slots and other structure may be filled with a dielectric such as air.

In order to provide an end user of device 10 with as large of a display as possible (e.g., to maximize an area of the device used for displaying media, running applications, etc.), it may be desirable to increase the amount of area at the front face of device 10 that is covered by active area AA of display 14. Increasing the size of active area AA may reduce the size of inactive area IA within device 10. This may reduce the area behind display 14 that is available for antennas within device 10. For example, active area AA of display 14 may include conductive structures that serve to block radio-frequency signals handled by antennas mounted behind active area AA from radiating through the front face of device 10. It would therefore be desirable to be able to provide antennas that occupy a small amount of space within device 10 (e.g., to allow for as large of a display active area AA as possible) while still allowing the antennas to communicate with wireless equipment external to device 10 with satisfactory efficiency bandwidth.

In a typical scenario, device 10 may have one or more upper antennas and one or more lower antennas (as an example). An upper antenna may, for example, be formed at the upper end of device 10 in region 20. A lower antenna may, for example, be formed at the lower end of device 10 in region 22. Additional antennas may be formed along the edges of housing 12 extending between regions 20 and 22 if desired. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, near-field communications, ultra-wideband communications, etc.

Figure 2:
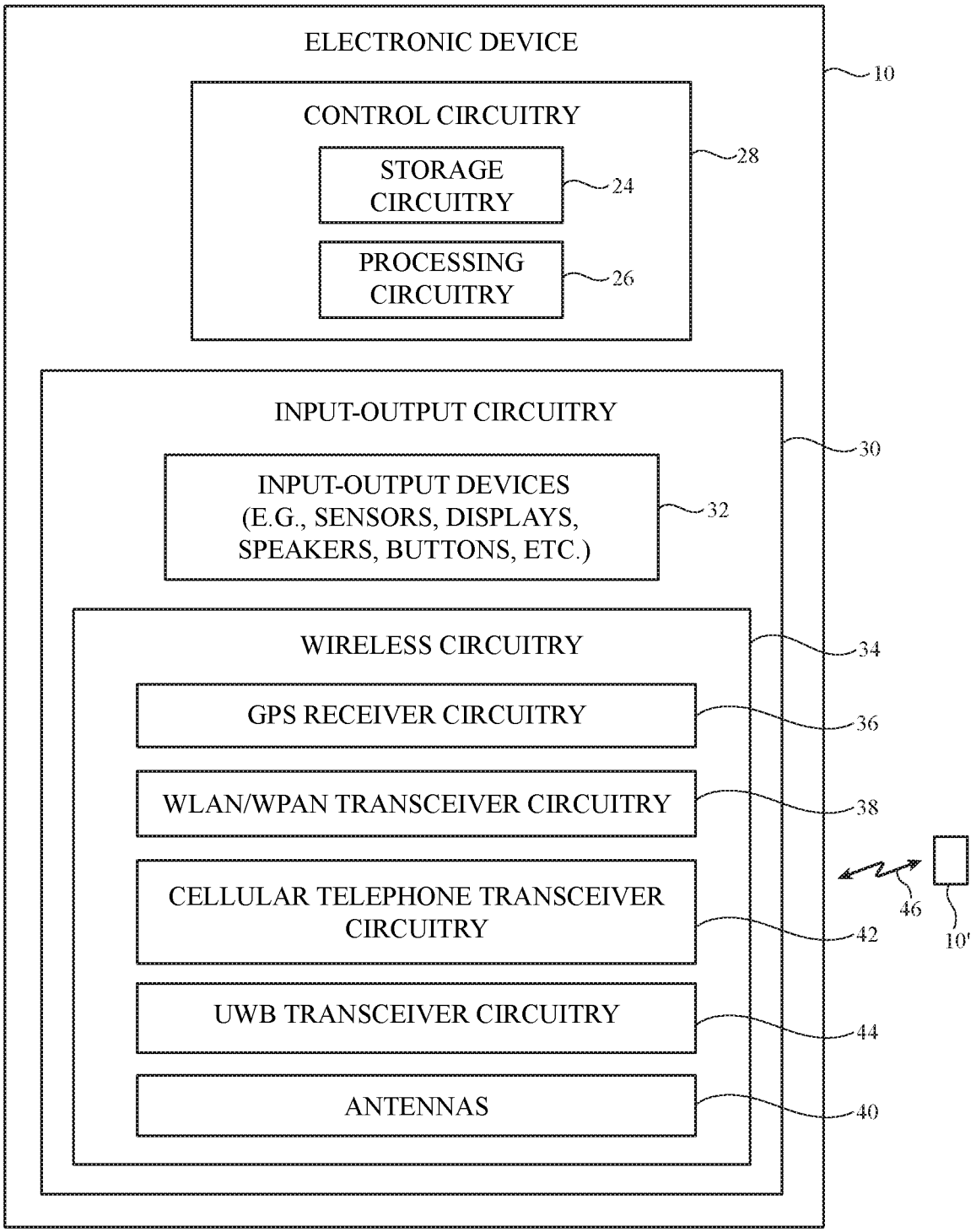
FIG. 2 is a schematic diagram of illustrative circuitry in an electronic device in accordance with some embodiments.

A schematic diagram of illustrative components that may be used in device 10 is shown in FIG. 2. As shown in FIG. 2, device 10 may include control circuitry 28. Control circuitry 28 may include storage such as storage circuitry 24. Storage circuitry 24 may include hard disk drive storage, nonvolatile memory (e.g., flash memory or other electrically-programmable-read-only memory configured to form a solid-state drive), volatile memory (e.g., static or dynamic random-access-memory), etc.

Control circuitry 28 may include processing circuitry such as processing circuitry 26. Processing circuitry 26 may be used to control the operation of device 10. Processing circuitry 26 may include on one or more microprocessors, microcontrollers, digital signal processors, host processors, baseband processor integrated circuits, application specific integrated circuits, central processing units (CPUs), etc. Control circuitry 28 may be configured to perform operations in device 10 using hardware (e.g., dedicated hardware or circuitry), firmware, and/or software. Software code for performing operations in device 10 may be stored on storage circuitry 24 (e.g., storage circuitry 24 may include non-transitory (tangible) computer readable storage media that stores the software code). The software code may sometimes be referred to as program instructions, software, data, instructions, or code. Software code stored on storage circuitry 24 may be executed by processing circuitry 26.

Control circuitry 28 may be used to run software on device 10 such as external node location applications, satellite navigation applications, internet browsing applications, voice-over-internet-protocol (VOIP) telephone call applications, email applications, media playback applications, operating system functions, etc. To support interactions with external equipment, control circuitry 28 may be used in implementing communications protocols. Communications protocols that may be implemented using control circuitry 28 include internet protocols, wireless local area network protocols (e.g., IEEE 802.11 protocols—sometimes referred to as Wi-Fi®), protocols for other short-range wireless communications links such as the Bluetooth® protocol or other wireless personal area network (WPAN) protocols, IEEE 802.11ad protocols, cellular telephone protocols, MIMO protocols, antenna diversity protocols, satellite navigation system protocols (e.g., global positioning system (GPS) protocols, global navigation satellite system (GLONASS) protocols, etc.), IEEE 802.15.4 ultra-wideband communications protocols or other ultra-wideband communications protocols, etc. Each communications protocol may be associated with a corresponding radio access technology (RAT) that specifies the physical connection methodology used in implementing the protocol.

Device 10 may include input-output circuitry 30. Input-output circuitry 30 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices 32 may include touch screens, displays without touch sensor capabilities, buttons, scrolling wheels, touch pads, key pads, keyboards, microphones, cameras, buttons, speakers, status indicators, light sources, audio jacks and other audio port components, vibrators or other haptic feedback engines, digital data port devices, light sensors (e.g., infrared light sensors, visible light sensors, etc.), light-emitting diodes, motion sensors (accelerometers), capacitance sensors, proximity sensors, magnetic sensors, force sensors (e.g., force sensors coupled to a display to detect pressure applied to the display), etc.

Input-output circuitry 30 may include wireless circuitry 34. To support wireless communications, wireless circuitry 34 may include radio-frequency (RF) transceiver circuitry formed from one or more integrated circuits, power amplifier circuitry, low-noise input amplifiers, passive RF components, one or more antennas such as antennas 40, transmission lines, and other circuitry for handling RF wireless signals. Wireless signals can also be sent using light (e.g., using infrared communications).

While control circuitry 28 is shown separately from wireless circuitry 34 in the example of FIG. 2 for the sake of clarity, wireless circuitry 34 may include processing circuitry that forms a part of processing circuitry 26 and/or storage circuitry that forms a part of storage circuitry 24 of control circuitry 28 (e.g., portions of control circuitry 28 may be implemented on wireless circuitry 34). As an example, control circuitry 28 (e.g., processing circuitry 26) may include baseband processor circuitry or other control components that form a part of wireless circuitry 34.

Wireless circuitry 34 may include radio-frequency transceiver circuitry for handling various radio-frequency communications bands. For example, wireless circuitry 34 may include wireless local area network (WLAN) and wireless personal area network (WPAN) transceiver circuitry 38. Transceiver circuitry 38 may handle 2.4 GHz and 5 GHz bands for WiFi® (IEEE 802.11) communications or other WLAN bands and may handle the 2.4 GHz Bluetooth® communications band or other WPAN bands. Transceiver circuitry 38 may sometimes be referred to herein as WLAN/WPAN transceiver circuitry 38.

Wireless circuitry 34 may use cellular telephone transceiver circuitry 42 for handling wireless communications in frequency ranges (communications bands) such as a cellular low band (LB) from 600 to 960 MHz, a cellular low-midband (LMB) from 1410 to 1510 MHz, a cellular mid-band (MB) from 1710 to 2170 MHz, a cellular high band (HB) from 2300 to 2700 MHz, a cellular ultra-high band (UHB) from 3300 to 5850 MHz, or other communications bands between 600 MHz and 5850 MHz or other suitable frequencies (as examples). Cellular telephone transceiver circuitry 42 may handle voice data and non-voice data.

Wireless circuitry 34 may include satellite navigation system circuitry such as Global Positioning System (GPS) receiver circuitry 36 for receiving GPS signals at 1575 MHz or for handling other satellite positioning data (e.g., GLONASS signals at 1609 MHz). Satellite navigation system signals for receiver circuitry 36 are received from a constellation of satellites orbiting the earth. Wireless circuitry 34 can include circuitry for other short-range and long-range wireless links if desired. For example, wireless circuitry 34 may include circuitry for receiving television and radio signals, paging system transceivers, near field communications (NFC) transceiver circuitry (e.g., an NFC transceiver operating at 13.56 MHz or another suitable frequency), etc.

In NFC links, wireless signals are typically conveyed over a few inches at most. In satellite navigation system links, cellular telephone links, and other long-range links, wireless signals are typically used to convey data over thousands of feet or miles. In WLAN and WPAN links at 2.4 and 5 GHz and other short-range wireless links, wireless signals are typically used to convey data over tens or hundreds of feet. Antenna diversity schemes may be used if desired to ensure that the antennas that have become blocked or that are otherwise degraded due to the operating environment of device 10 can be switched out of use and higher-performing antennas used in their place.

Wireless circuitry 34 may include ultra-wideband (UWB) transceiver circuitry 44 that supports communications using the IEEE 802.15.4 protocol and/or other ultra-wideband communications protocols. Ultra-wideband radio-frequency signals may be based on an impulse radio signaling scheme that uses band-limited data pulses. Ultra-wideband radio-frequency signals may have any desired bandwidths such as bandwidths between 499 MHz and 1331 MHz, bandwidths greater than 500 MHz, etc. The presence of lower frequencies in the baseband may sometimes allow ultra-wideband radio-frequency signals to penetrate through objects such as walls. In an IEEE 802.15.4 system, a pair of electronic devices may exchange wireless time stamped messages. Time stamps in the messages may be analyzed to determine the time of flight of the messages and thereby determine the distance (range) between the devices and/or an angle between the devices (e.g., an angle of arrival of incoming radio-frequency signals). UWB transceiver circuitry 44 may operate (i.e., convey radio-frequency signals) in frequency bands such as an ultra-wideband communications band between about 5 GHz and about 8.3 GHz (e.g., a 6.5 GHz UWB communications band, an 8 GHz UWB communications band, and/or at other suitable frequencies).

As an example, device 10 may convey radio-frequency signals 46 at ultra-wideband frequencies with external wireless equipment 10' to determine a distance between device 10 and external wireless equipment 10' and/or to determine an angle of arrival of radio-frequency signals 46 (e.g., to determine the relative orientation and/or position of external wireless equipment 10' with respect to device 10). External wireless equipment 10' may be an electronic device like device 10 or may include any other desired wireless equipment. Radio-frequency signals conveyed by device 10 in an ultra-wideband communications band and using an ultra-wideband communications protocol (e.g., radio-frequency signals 46) may sometimes be referred to herein as ultra-wideband signals. Radio-frequency signals conveyed by device 10 in other communications bands (e.g., using communications protocols other than an ultra-wideband communications protocol) may sometimes be referred to here as non-ultra-wideband (non-UWB) signals. Non-UWB signals conveyed by device 10 may include, for example, radio-frequency signals in a cellular telephone communications band, a WLAN communications band, etc.

Wireless circuitry 34 may include antennas 40. Antennas 40 may be formed using any suitable types of antenna structures. For example, antennas 40 may include antennas with resonating elements that are formed from loop antenna structures, patch antenna structures, inverted-F antenna structures, slot antenna structures, planar inverted-F antenna structures, helical antenna structures, dipole antenna structures, monopole antenna structures, hybrids of two or more of these designs, etc. If desired, one or more of antennas 40 may be cavity-backed antennas.

Different types of antennas may be used for different bands and combinations of bands. For example, one type of antenna may be used in forming a local wireless link antenna and another type of antenna may be used in forming a remote wireless link antenna. Dedicated antennas may be used for conveying radio-frequency signals in a UWB communications band (e.g., UWB signals) or, if desired, antennas 40 can be configured to convey both radio-frequency signals in a UWB communications band and radio-frequency signals in non-UWB communications bands (e.g., wireless local area network signals and/or cellular telephone signals). Antennas 40 can include two or more antennas for handling ultra-wideband wireless communication. In one suitable arrangement that is described herein as an example, antennas 40 include one or more groups of three antennas (sometimes referred to herein as triplets of antennas) for handling ultra-wideband wireless communication. In yet another suitable arrangement, antennas 40 may include a triplet of sets of antennas, where each set of antenna includes four antennas that are tuned to four respective frequencies (e.g., antennas 40 may include three sets of four antennas for handling ultra-wideband wireless communication). Antennas 40 may include one or more doublets of antennas for handling ultra-wideband wireless communication if desired.

Space is often at a premium in electronic devices such as device 10. In order to minimize space consumption within device 10, the same antenna 40 may be used to cover multiple communications bands. In one suitable arrangement that is described herein as an example, each antenna 40 that is used to perform ultra-wideband wireless communication may be a multi-band antenna that conveys radio-frequency signals in at least two ultra-wideband communications bands (e.g., the 6.5 GHz UWB communications band and the 8.0 GHz UWB communications band).

Figure 3:
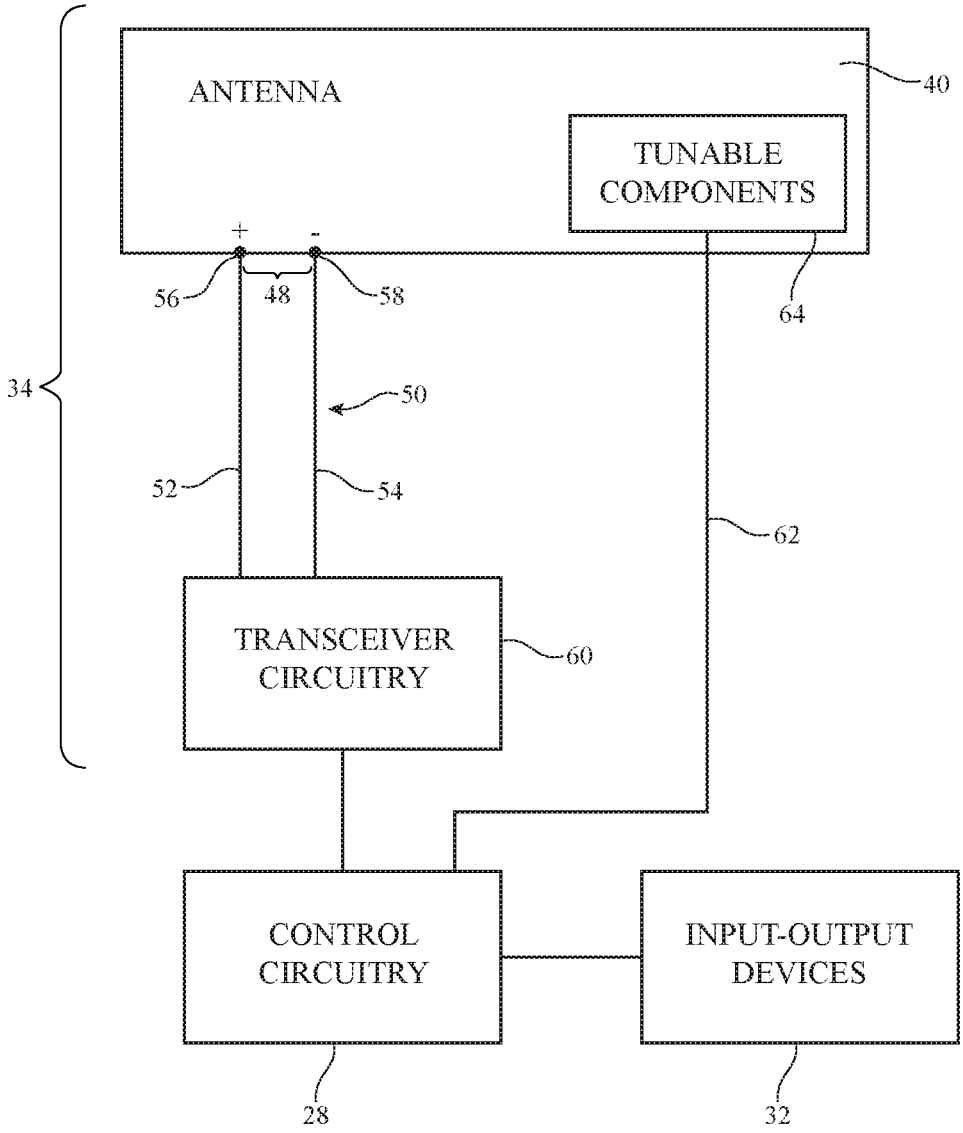
FIG. 3 is a schematic diagram of illustrative wireless circuitry in accordance with some embodiments.

As shown in FIG. 3, wireless circuitry 34 may include transceiver circuitry 60 (e.g., GPS receiver circuitry 36, WLAN/WPAN circuitry 38, cellular telephone transceiver circuitry 42, and/or UWB transceiver circuitry 44 of FIG. 2). Transceiver circuitry 60 may be coupled to antenna structures such as a given antenna 40 using a radio-frequency transmission line path such as radio-frequency transmission line path 50. Wireless circuitry 34 may be coupled to control circuitry 28. Control circuitry 28 may be coupled to input-output devices 32. Input-output devices 32 may supply output from device 10 and may receive input from sources that are external to device 10.

To provide antenna structures such as antenna 40 with the ability to cover communications frequencies of interest, antenna 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna 40 may be provided with adjustable circuits such as tunable components 64 to tune the antenna over communications (frequency) bands of interest. Tunable components 64 may be part of a tunable filter or tunable impedance matching network, may be part of an antenna resonating element, may span a gap between an antenna resonating element and antenna ground, etc.

Tunable components 64 may include tunable inductors, tunable capacitors, or other tunable components. Tunable components such as these may be based on switches and networks of fixed components, distributed metal structures that produce associated distributed capacitances and inductances, variable solid-state devices for producing variable capacitance and inductance values, tunable filters, or other suitable tunable structures. During operation of device 10, control circuitry 28 may issue control signals on one or more control paths such as control path 62 that adjust inductance values, capacitance values, or other parameters associated with tunable components 64, thereby tuning antenna 40 to cover desired communications bands. Antenna tuning components that are used to adjust the frequency response of antenna 40 such as tunable components 64 may sometimes be referred to herein as antenna tuning components, tuning components, antenna tuning elements, tuning elements, adjustable tuning components, adjustable tuning elements, or adjustable components.

Radio-frequency transmission line path 50 may include one or more radio-frequency transmission lines. Radio-frequency transmission lines in radio-frequency transmission line path 50 may, for example, include coaxial cable transmission lines, stripline transmission lines, microstrip transmission lines, coaxial probes realized by a metalized vias, edge-coupled microstrip transmission lines, edge-coupled stripline transmission lines, waveguide structures (e.g., coplanar waveguides or grounded coplanar waveguides), combinations of these types of radio-frequency transmission lines and/or other transmission line structures, etc.

Radio-frequency transmission line path 50 may have a positive signal conductor such as signal conductor 52 and a ground signal conductor such as ground conductor 54. The radio-frequency transmission lines in radio-frequency transmission line path 50 may, for example, be integrated into rigid and/or flexible printed circuit boards. In one suitable arrangement, radio-frequency transmission lines in radio-frequency transmission line path 50 may also include transmission line conductors (e.g., signal conductors 52 and ground conductors 54) integrated within multilayer laminated structures (e.g., layers of a conductive material such as copper and a dielectric material such as a resin that are laminated together without intervening adhesive). The multilayer laminated structures may, if desired, be folded or bent in multiple dimensions (e.g., two or three dimensions) and may maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

A matching network (e.g., an adjustable matching network formed using tunable components 64) may include components such as inductors, resistors, and capacitors used in matching the impedance of antenna 40 to the impedance of radio-frequency transmission line path 50. Matching network components may be provided as discrete components (e.g., surface mount technology components) or may be formed from housing structures, printed circuit board structures, traces on plastic supports, etc. Components such as these may also be used in forming filter circuitry in antenna 40 and may be tunable and/or fixed components.

Radio-frequency transmission line path 50 may be coupled to antenna feed structures associated with antenna 40. As an example, antenna 40 may form an inverted-F antenna, a slot antenna, a monopole antenna, a dipole antenna, or other antenna having an antenna feed 48 with a positive antenna feed terminal such as positive antenna feed terminal 56 and a ground antenna feed terminal such as ground antenna feed terminal 58. Signal conductor 52 may be coupled to positive antenna feed terminal 56 and ground conductor 54 may be coupled to ground antenna feed terminal 58. Other types of antenna feed arrangements may be used if desired. For example, antenna 40 may be fed using multiple feeds each coupled to a respective port of radio-frequency transceiver circuitry 60 over a corresponding radio-frequency transmission line path. If desired, signal conductor 52 may be coupled to multiple locations on antenna 40 (e.g., antenna 40 may include multiple positive antenna feed terminals coupled to signal conductor 52 of the same radio-frequency transmission line path 50). Switches may be interposed on the signal conductor between radio-frequency transceiver circuitry 60 and the positive antenna feed terminals if desired (e.g., to selectively activate one or more positive antenna feed terminals at any given time). The illustrative feeding configuration of FIG. 3 is merely illustrative.

Control circuitry 28 may use information from a proximity sensor, wireless performance metric data such as received signal strength information, device orientation information from an orientation sensor, device motion data from an accelerometer or other motion detecting sensor, information about a usage scenario of device 10, information about whether audio is being played through speaker port 16 (FIG. 1), information from one or more antenna impedance sensors, information on desired frequency bands to use for communications, and/or other information in determining when antenna 40 is being affected by the presence of nearby external objects or is otherwise in need of tuning. In response, control circuitry 28 may adjust an adjustable inductor, adjustable capacitor, switch, or other tunable components such as tunable components 64 to ensure that antenna 40 operates as desired. Adjustments to tunable components 64 may also be made to extend the frequency coverage of antenna 40 (e.g., to cover desired communications bands that extend over a range of frequencies larger than antenna 40 would cover without tuning).

Antenna 40 may include antenna resonating element structures (sometimes referred to herein as radiating element structures), antenna ground plane structures (sometimes referred to herein as ground plane structures, ground structures, or antenna ground structures), an antenna feed such as antenna feed 48, and other components (e.g., tunable components 64). Antenna 40 may be configured to form any suitable type of antenna.

Figure 4:
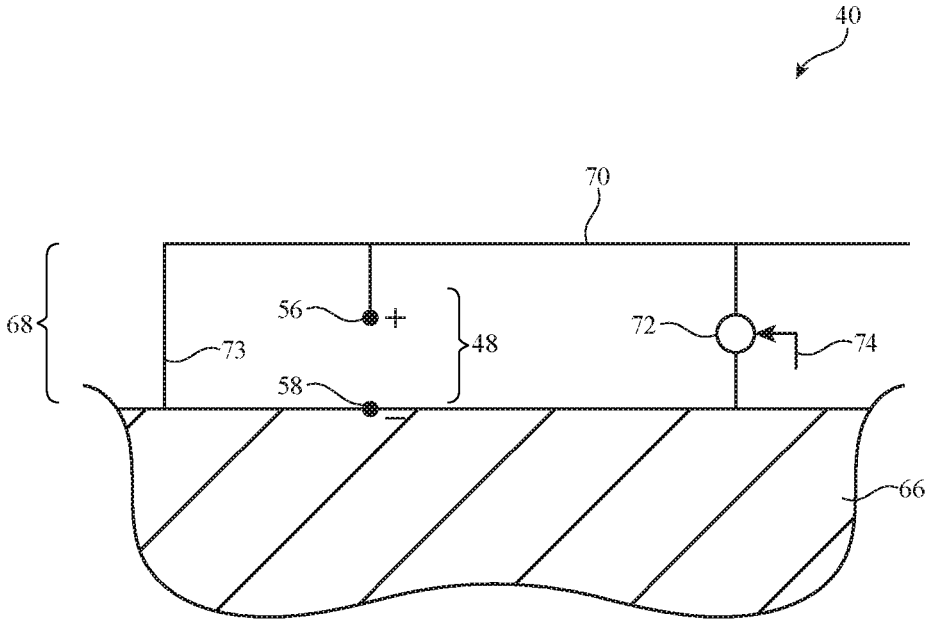
FIG. 4 is a diagram of an illustrative antenna having an antenna resonating element arm and an antenna ground in accordance with some embodiments.

FIG. 4 is a schematic diagram of antenna structures that may be used in forming antenna 40. As shown in FIG. 4, antenna 40 may include an antenna resonating element such as antenna resonating element 68 (e.g., an inverted-F antenna resonating element) and an antenna ground (sometimes referred to herein as a ground plane) such as antenna ground 66. Antenna resonating element 68 may have a main resonating element arm such as arm 70. The length of arm 70 may be selected so that antenna 40 resonates at desired operating frequencies (e.g., where the length of arm 70 is approximately equal to one-quarter of the effective wavelength corresponding to a frequency in a communications band handled by antenna 40). Antenna resonating element 68 may also exhibit resonances at harmonic frequencies.

If desired, other conductive structures in the vicinity of arm 70 may contribute to the radiative response of antenna 40 (e.g., antenna resonating element 68 may include conductive structures that are separate from arm 70 such as conductive portions of other antennas in the vicinity of antenna 40). Arm 70 may be separated from antenna ground 66 by a dielectric-filled opening or gap. Antenna ground 66 may be formed from housing structures such as a conductive support plate, conductive portions of display 14 (FIG. 1), conductive traces on a printed circuit board, metal portions of electronic components, or other conductive ground structures.

If desired, arm 70 may be coupled to antenna ground 66 by one or more return paths such as return path 73. Positive antenna feed terminal 56 of antenna feed 48 may be coupled to arm 70. Ground antenna feed terminal 58 may be coupled to antenna ground 66 (e.g., antenna feed 48 may run parallel to return path 73). If desired, antenna resonating element 68 may include one or more tunable components that are coupled between arm 70 and antenna ground 66. As shown in FIG. 4, for example, a tunable component such as tunable component 72 (e.g., a tunable component such as tunable component 64 of FIG. 3) may be coupled between arm 70 and antenna ground 66. Tunable component 72 may exhibit a capacitance, resistance, and/or inductance that is adjusted in response to control signals 74 provided to tunable component 72 from control circuitry 28 (FIG. 3). If desired, antenna resonating element 68 may include more than one resonating arm to support radiation in multiple communications bands.

Figure 5:
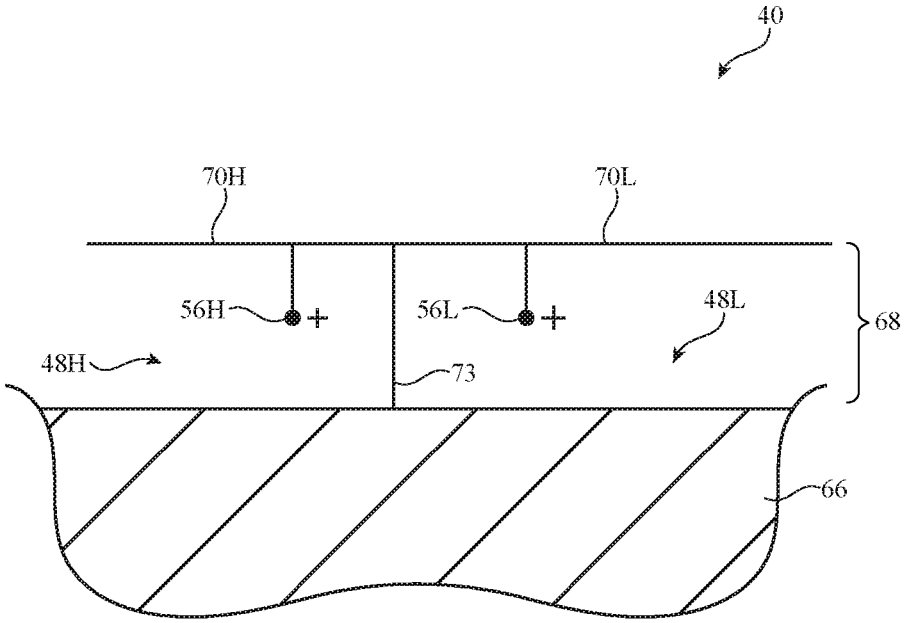
FIG. 5 is a diagram of an illustrative antenna having multiple antenna resonating element arms in accordance with some embodiments.

FIG. 5 is a schematic diagram of antenna 40 in an example where antenna resonating element 68 includes multiple resonating element arms to support radiation in multiple communications bands (e.g., where antenna 40 is a dual band inverted-F antenna). As shown in FIG. 5, antenna resonating element 68 may include a first resonating element arm 70L and a second resonating element arm 70H extending from opposing sides of return path 73.

The length of first resonating element arm 70L (sometimes referred to herein as low band arm 70L) may be selected to radiate in a first frequency band and the length of second resonating element arm 70H (sometimes referred to herein as high band arm 70H) may be selected to radiate in a second frequency band at higher frequencies than the first frequency band. As an example, low band arm 70L may have a length that configures low band arm 70L to radiate in the 6.5 GHz UWB communications band whereas high band arm 70H has a length that configures high band arm 70H to radiate in the 8.0 GHz UWB communications band.

Antenna 40 of FIG. 5 may be fed using two antenna feeds such as antenna feed 48H and antenna feed 48L. Antenna feed 48H may include a positive antenna feed terminal 56H coupled to high band arm 70H. Antenna feed 48L may include a positive antenna feed terminal 56L coupled to low band arm 70L. The ground antenna feed terminals of antenna feeds 48L and 48H are not shown in the example of FIG. 5 for the sake of clarity. If desired, antenna feeds 48L and 48H may share the same ground antenna feed terminal. Positive antenna feed terminals 56H and 56L may both be coupled to the same transmission line (e.g., to the same signal conductor 52 as shown in FIG. 3). This may, for example, optimize antenna efficiency of antenna 40 in both the frequency band covered by low band arm 70L and the frequency band covered by high band arm 70H (e.g., because antenna current may be conveyed to each resonating element arm over the corresponding positive antenna feed terminal without first shorting to ground over return path 73).

In one suitable arrangement that is sometimes described herein as an example, antenna 40 may be a dual-band planar inverted-F antenna. When configured as a dual-band planar inverted-F antenna, resonating element arms 70H and 70L may be formed using a substantially planar conductive structure (e.g., a conductive trace or patch, sheet metal, conductive foil, etc.) that extends across a planar lateral area above antenna ground 66. The examples of FIGS. 4 and 5 are merely illustrative. Antenna 40 may be formed using any desired antenna structures and may be fed using any desired feeding arrangement. The resonating element arms of antenna 40 (e.g., arm 70 of FIG. 4 or arms 70H and 70L of FIG. 5) may have any desired shape following any desired paths (e.g., paths having curved and/or straight segments, shapes having any desired number of curved and/or straight sides, etc.). Antenna 40 of FIG. 5 may include one or more tunable components (e.g., tunable component 72 of FIG. 4) if desired.

Figure 6:
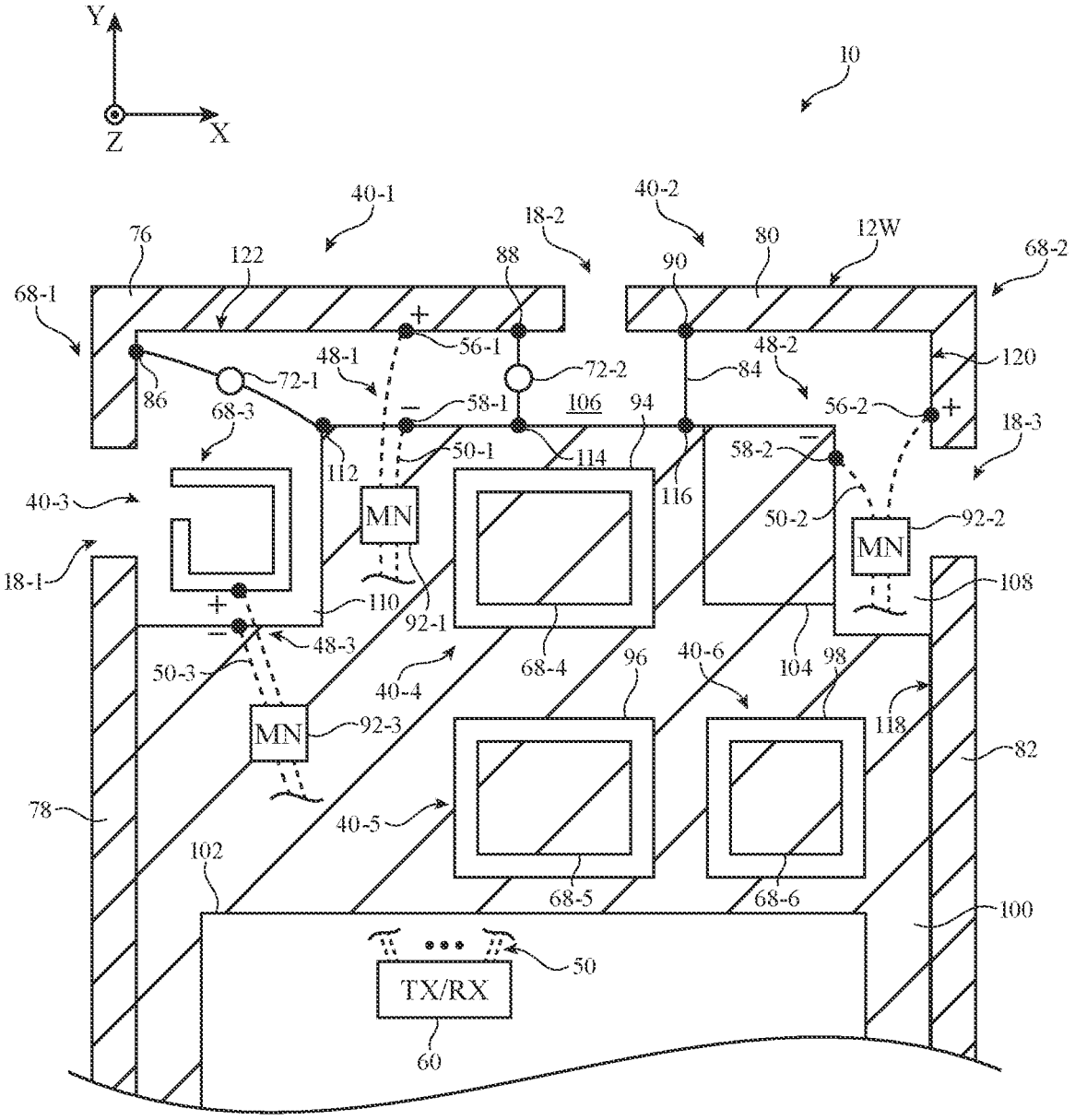
FIG. 6 is a top view showing how an illustrative electronic device may include multiple antennas for covering different communications bands in accordance with some embodiments.

A top interior view of an illustrative portion of device 10 that contains multiple antennas 40 is shown in FIG. 6 (e.g., at the upper end of device 10 within region 20 of FIG. 1). As shown in FIG. 6, device 10 may have peripheral conductive housing structures such as peripheral conductive housing structures 12W. Peripheral conductive housing structures 12W may be divided by dielectric-filled peripheral gaps 18 (e.g., plastic gaps) such as gaps 18-1, 18-2, and 18-3. Gap 18-1 may divide peripheral conductive housing structures 12W into segment 78 and segment 76. Gap 18-2 may separate segment 76 from segment 80 of peripheral conductive housing structures 12W. Gap 18-3 may separate segment 80 from segment 82 of peripheral conductive housing structures 12W.

As shown in FIG. 6, device 10 may include at least six antennas 40 such as a first antenna 40-1, a second antenna 40-2, a third antenna 40-3, a fourth antenna 40-4, a fifth antenna 40-5, and a sixth antenna 40-6. Antennas 40-1, 40-2, 40-3, 40-4, 40-5, and 40-6 may share ground structures 100, which form the antenna ground (e.g., antenna ground 66 of FIGS. 4 and 5) for the antennas. Other components such as camera module 104 may be located in the vicinity of one or more antennas such as antenna 40-2.

Segments 76 and 80 of peripheral conductive housing structures 12W may be separated from ground structures 100 by dielectric-filled slot 106. Air, plastic, ceramic, glass, and/or other dielectric materials may fill slot 106. In one suitable arrangement, slot 106 may be continuous with gaps 18-1, 18-2, and 18-3, and a single piece of dielectric material (e.g., plastic) may fill slot 106, gap 18-1, gap 18-2, and gap 18-3. Dielectric material in slot 106 may lie flush with the exterior surface of device 10 if desired.

Antennas 40-1, 40-2, 40-3, 40-4, 40-5, and 40-6 may be coupled to transceiver circuitry 60 by corresponding radio-frequency transmission line paths 50. Transceiver circuitry 60 may be mounted to a substrate such as logic board 102 (e.g., a main logic board for device 10). Logic board 102 may include a rigid printed circuit board, a flexible printed circuit, an integrated circuit, an integrated circuit package, and/or any other desired substrates. Filter circuitry, switching circuitry, or any other desired radio-frequency circuitry (not shown in FIG. 6 for the sake of clarity) may be interposed on radio-frequency transmission line paths 50 between transceiver circuitry 60 and the antennas in device 10.

Antenna 40-1 may have an antenna resonating element 68-1 that includes one or more antenna resonating element arms (e.g., arm 70 of FIG. 4 or arms 70H and 70L of FIG. 5) formed from segment 76 of peripheral conductive housing structures 12W. The length of segment 76 may be selected to provide antenna 40-1 with response peaks in one or more communications bands. Antenna 40-1 may have an antenna feed 48-1 with a positive antenna feed terminal 56-1 coupled to segment 76 and a ground antenna feed terminal 58-1 coupled to ground structures 100. The length of segment 76 from antenna feed 48-1 to gap 18-1 and/or the length of segment 76 from antenna feed 48-1 to gap 18-2 may, for example, be approximately equal to one-quarter of an effective wavelength of operation of antenna 40-2 (e.g., where the effective wavelength is equal to the free space wavelength modified by a constant value determined by the dielectric material in slot 106). Antenna 40-1 may also have one or more harmonic modes and/or parasitic elements that cover additional frequencies. Slot 106 may also be a radiating slot that contributes to the frequency response of antenna 40-1 (e.g., antenna 40-1 may be a hybrid inverted-F slot antenna).

Antenna feed 48-1 may be coupled to transceiver circuitry 60 using radio-frequency transmission line path 50-1. Impedance matching circuitry such as matching network (MN) 92-1 may be interposed on radio-frequency transmission line path 50-1. Matching network 92-1 may serve to match the impedance of radio-frequency transmission line path 50-1 to the impedance of antenna 40-1 and/or to tune the frequency response of antenna 40-1. Antenna 40-1 may also include one or more tunable components such as a first tunable component 72-1 and a second tunable component 72-2 (e.g., tunable components such as tunable component 64 of FIG. 3). Tunable component 72-1 may have a first terminal 86 coupled to segment 76 and a second (ground) terminal 112 coupled to ground structures 100. Tunable component 72-2 may have a first terminal 88 coupled to segment 76 and a second (ground) terminal 114 coupled to ground structures 100. Positive antenna feed terminal 56-1 may be interposed on segment 76 between terminals 86 and 88. Tunable components 72-1 and 72-2 may help to tune the frequency response of antenna 40-1.

Similarly, antenna 40-2 may have an antenna resonating element 68-2 that includes one or more antenna resonating element arms (e.g., arm 70 of FIG. 4 or arms 70H and 70L of FIG. 5) formed from segment 80 of peripheral conductive housing structures 12W. Segment 80 may be coupled to ground structures 100 by return path 84 (e.g., a return path such as return path 73 of FIGS. 4 and 5). Return path 84 may have a first terminal 90 coupled to segment 80 and a second terminal 116 coupled to ground structures 100. The length of segment 80 may be selected to provide antenna 40-2 with response peaks in one or more communications bands. Antenna 40-2 may also have one or more harmonic modes and/or parasitic elements that cover additional frequencies. Slot 106 may be a radiating slot that contributes to the frequency response of antenna 40-2 (e.g., antenna 40-2 may be a hybrid inverted-F slot antenna).

Antenna 40-2 may have an antenna feed 48-2 with a positive antenna feed terminal 56-2 coupled to segment 80 and a ground antenna feed terminal 58-2 coupled to ground structures 100. Antenna feed 48-2 may be coupled to transceiver circuitry 60 using radio-frequency transmission line path 50-2. Impedance matching circuitry such as matching network (MN) 92-2 may be interposed on radio-frequency transmission line path 50-2. Matching network 92-2 may serve to match the impedance of radio-frequency transmission line path 50-2 to the impedance of antenna 40-2 and/or to tune the frequency response of antenna 40-2. If desired, other tunable components (e.g., tunable components 64 of FIG. 3) may be coupled to antenna resonating element 68-2 to help tune the frequency response of antenna 40-2 (not shown in FIG. 6 for the sake of clarity).

The edge of ground structures 100 defining the lower edge of slot 106 may be aligned with the lower edge of gaps 18-1 and 18-3 or, as shown in the arrangement of FIG. 6, may extend parallel to the Y-axis beyond the lower edge of gaps 18-1 and 18-3. For example, slot 106 may include a first extended portion 110 that extends below gap 18-1 and a second extended portion 108 that extends below gap 18-3 (e.g., extended portions 110 and 108 may form opposing sides of slot 106 along the longest dimension of slot 106). If desired, extended portion 110 of slot 106 may contribute to the frequency response of antenna 40-1 (e.g., the perimeter of extended portion 110 may contribute additional response peaks for antenna 40-1). If desired, extended portion 108 of slot 106 may contribute to the frequency response of antenna 40-2 (e.g., the perimeter of extended portion 108 may contribute additional response peaks for antenna 40-1). Tunable components may, if desired, be coupled across extended portions 108 and/or 110 (e.g., between ground structures 100 and interior surface 118 of segment 82) to help tune the frequency response of antennas 40-2 and 40-1 (not shown in FIG. 6 for the sake of clarity). The example of FIG. 6 is merely illustrative and, in general, slot 106 may have any desired shape and may follow any desired path (e.g., any desired shape having any desired number of curved and/or straight edges and any desired path having any desired number of straight and/or curved segments).

Antenna 40-3 may have an antenna resonating element 68-3 that at least partially (e.g., completely) overlaps slot 106 (e.g., extended portion 110 of slot 106). Antenna resonating element 68-3 may include one or more antenna resonating element arms (e.g., arm 70 of FIG. 4, arms 70H and 70L of FIG. 5, monopole resonating element arms, dipole resonating element arms, etc.). Antenna resonating element 68-3 may also include portions of segment 76 and/or tunable component 72-1 if desired (e.g., antenna currents conveyed by antenna feed 48-3 may induce corresponding antenna currents on portions of antenna 40-1 via near-field electromagnetic coupling). The length of antenna resonating element 68-3 may be selected to provide antenna 40-3 with response peaks in one or more communications bands. Harmonic modes of antenna resonating element 68-3 may also contribute the frequency response of antenna 40-3.

Antenna 40-3 may have an antenna feed 48-3 with a positive antenna feed terminal coupled to antenna resonating element 68-3 and a ground antenna feed terminal coupled to ground structures 100. Antenna feed 48-3 may be coupled to transceiver circuitry 60 using radio-frequency transmission line path 50-3. Impedance matching circuitry such as matching network (MN) 92-3 may be interposed on radio-frequency transmission line path 50-3. Matching network 92-3 may serve to match the impedance of radio-frequency transmission line path 50-3 to the impedance of antenna 40-3 and/or to tune the frequency response of antenna 40-3. If desired, tunable components (e.g., tunable component 64 of FIG. 3) may be coupled to antenna 40-3 to help tune the frequency response of antenna 40-3 (not shown in FIG. 6 for the sake of clarity).

Antennas 40-1, 40-2, and 40-3 may be configured to cover any desired communications bands. In one suitable arrangement that is sometimes described herein as an example, antenna 40-1 may convey radio-frequency signals in a cellular low band (e.g., between 617 and 960 MHz), a cellular low-mid band (e.g., between 1430 and 1510 MHz), a cellular mid band (e.g., between 1710 and 2170 MHz), a satellite navigation band (e.g., a GPS band between 1565 and 1605 MHz), and/or a cellular high band (e.g., between 2300 and 2700 MHz). Antenna 40-2 may convey radio-frequency signals in the cellular midband, the cellular high band, a first WLAN band and/or WPAN band at 2.4 GHz (e.g., between 2400 and 2480 MHz), and/or a cellular ultra-high band (e.g., between 3400 and 3700 MHz). Antenna 40-3 may convey radio-frequency signals in the cellular ultra-high band, a second WLAN band at 5 GHz (e.g., between 5180 and 5850 MHz), a first ultra-wideband communications band (e.g., between 6250 and 6750 MHz such as in UWB channel 5), and/or a second ultra-wideband communications band (e.g., between 7750 and 8250 MHz such as in UWB channel 9). Tunable component 72-1 may, for example, tune the frequency response of antenna 40-1 in the cellular midband and/or cellular low-midband. Tunable component 72-2 may, for example, tune the frequency response of antenna 40-1 in the cellular low band. This example is merely illustrative and, in general, antennas 40-1, 40-2, and 40-3 may each cover some or all of any of these bands and/or other communications bands.

Ground structures 100 may be formed from conductive housing structures, from electrical device components in device 10, from printed circuit board traces, from strips of conductor such as strips of wire and metal foil, from conductive portions of display 14 (FIG. 1), and/or other conductive structures. In one suitable arrangement, ground structures 100 may include conductive portions of housing 12 (e.g., portions of rear housing wall 12R of FIG. 1 and/or portions of a different conductive support plate in device 10) and conductive portions of display 14 (FIG. 1). Segments 78 and 82 of peripheral conductive housing structures 12W may be coupled to ground structures 100 and may therefore form part of the antenna ground for antennas 40-1, 40-2, 40-3, 40-4, 40-5, and/or 40-6. Segments 78 and 82 and ground structures 100 may be formed from a single integral piece of metal if desired.

If desired, ground structures 100 may include multiple conductive structures such as one or more conductive layers within device 10. For example, ground structures 100 may include a first conductive layer formed from a portion of housing 12 (e.g., a conductive backplate or support plate that forms part of rear housing wall 12R of FIG. 1) and a second conductive layer formed from a conductive display frame or support plate associated with display 14 (FIG. 1). In these scenarios, conductive interconnect structures (e.g., conductive screws, conductive brackets, conductive clips, conductive pins, conductive springs, solder, welds, conductive adhesive, conductive screw bosses, etc.) may electrically connect terminals 58-1, 58-2, 112, 114, 116, and/or the ground terminal for antenna feed 48-3 to both the conductive display layer and the conductive housing layer. This may allow ground structures 100 to extend across both conductive portions of housing 12 and display 14 (FIG. 1) so that the conductive material closest to antennas 40-1, 40-2, and 40-3 are held at a ground potential. This may, for example, serve to maximize the antenna efficiency of antenna 40-1, 40-2, and/or antenna 40-3.

Terminals 86, 56-1, and 88 may, for example, be coupled to interior (internal) surface 122 of segment 76, whereas terminals 90 and 56-2 are coupled to interior (internal) surface 120 of segment 80. Terminal 86 may include any desired conductive interconnect structures for coupling (e.g., electrically connecting, mechanically attaching or securing, etc.) tunable component 72-1 to segment 76. Similarly, positive antenna feed terminal 56-1 may include any desired conductive interconnect structures for coupling antenna feed 48-1 to segment 76, terminal 88 may include any desired conductive interconnect structures for coupling tunable component 72-2 to segment 76, terminal 90 may include any desired conductive interconnect structures for coupling return path 84 to segment 80, and positive antenna feed terminal 56-2 may include any desired conductive interconnect structures for coupling antenna feed 48-2 to segment 80. The conductive interconnect structures used to form terminals 86, 56-1, 88, 90, and 56-2 may include, for example, solder, welds, conductive adhesive, conductive foam, conductive clips, conductive pins, conductive brackets, conductive gaskets, conductive springs, conductive traces on underlying dielectric substrates, integral portions of peripheral conductive housing structures 12W (e.g., an inwardly-extending ledge or lip of peripheral conductive housing structures 12W), conductive screws, conductive screw bosses, conductive washers or other conductive structures having openings for receiving conductive screws or pins, and/or any other desired conductive interconnect structures.

As shown in FIG. 6, antenna 40-4 may include an antenna resonating element 68-4 aligned with opening 94 in ground structures 100, antenna 40-5 may include an antenna resonating element 68-5 aligned with opening 96 in ground structures 100, and antenna 40-6 may include an antenna resonating element 68-6 aligned with opening 98 in ground structures 100. Antenna resonating elements 68-4, 68-5, and 68-6 may each include respective antenna feeds that are coupled to transceiver circuitry 60 using corresponding radio-frequency transmission line paths 50 (not shown in FIG. 6 for the sake of clarity). In one suitable arrangement that is sometimes described herein as an example, antenna resonating elements 68-4, 68-5, and 68-6 may each be multi-band planar inverted-F antenna resonating elements (e.g., having multiple arms such as arms 70H and 70L of FIG. 5).

Antennas 40-4, 40-5, and 40-6 may, for example, be used to transmit and receive UWB signals through the rear face of device 10 (e.g., through rear housing wall 12R of FIG. 1). Antennas 40-4, 40-5, and 40-6 may, for example, form a triplet of antennas that can receive UWB signals that are processed by control circuitry 28 (FIG. 2) to determine a three-dimensional angle-of-arrival of the received UWB signals. Antennas 40-4, 40-5, and 40-6 may each convey the UWB signals in a first ultra-wideband communications band such as the 6.5 GHz ultra-wideband communications band (e.g., at frequencies between 6250 and 6750 MHz using arm 70L of FIG. 5) and in a second ultra-wideband communications band such as the 8.0 GHz ultra-wideband communications band (e.g., at frequencies between 7750 and 8250 MHz using arm 70H of FIG. 5).

Conductive structures over antennas 40-4, 40-5, and 40-6 (e.g., display 14 of FIG. 1, a battery for device 10, etc.) may effectively block antennas 40-4, 40-5, and 40-6 from transmitting or receiving UWB signals through the front face of device 10 (e.g., in the +Z direction). In order to help provide UWB coverage through the front face of device 10 (e.g., to provide a full sphere of UWB coverage around all sides of device 10), antenna 40-3 may also be used to transmit and/or receive UWB signals. Because antenna 40-3 is located at the corner of device 10, antenna 40-3 may be at least partially aligned with the inactive area of the display at the front face of device 10 (e.g., inactive area IA of display 14 of FIG. 1). This may allow antenna 40-3 to transmit and/or receive UWB signals through the front face of device 10 without the signals being blocked by conductive structures in display 14 (e.g., pixel circuitry or other components associated with active area AA of FIG. 1). Antenna currents induced on peripheral conductive housing structures 12W by antenna resonating element 68-3 may also help to ensure that antenna 40-3 can convey radio-frequency signals through the front face of device 10. Antenna 40-3 may also convey UWB signals through the rear face of device 10 (e.g., through slot 106 in the −Z direction) and laterally through gap 18-1 in peripheral conductive housing structures 12W.

Antenna 40-3 may be used to transmit UWB signals for use by external communications equipment (e.g., external communications equipment 10' of FIG. 2) in determining an angle of arrival of the transmitted UWB signals and/or a distance between the external communications equipment and device 10. If desired, antenna 40-3 may also be used to receive UWB signals from external communications equipment (e.g., external communications equipment 10' of FIG. 2) for use in determining the distance between the external communications equipment and device 10. In one suitable arrangement, antenna 40-3 may only transmit UWB signals without also receiving UWB signals. Because only a single antenna conveys UWB signals through the front face of device 10 in this example, the UWB signals conveyed by antenna 40-3 through the front face of device 10 may be used to determine a range between device 10 and the external wireless equipment without also determining an angle of arrival. This example is merely illustrative.

If desired, antenna 40-3 may also be used to convey non-UWB signals in one or more other communications bands in addition to conveying UWB signals. In one suitable arrangement that is sometimes described herein as an example, antenna 40-3 may convey non-UWB signals in first and second communications bands such as a 5.0 GHz WLAN communications band (e.g., a frequency band from about 5180 MHz to about 5850 MHz) and one or more cellular ultra-high bands at frequencies between about 3400 MHz and 3700 MHz. Examples of cellular ultra-high bands that may be covered by antenna 40-3 include Long Term Evolution (LTE) band B42 (e.g., between about 3.4 GHz and 3.6 GHz) and LTE band B48 (e.g., between about 3.6 GHz and 3.7 GHz).

Figure 7:
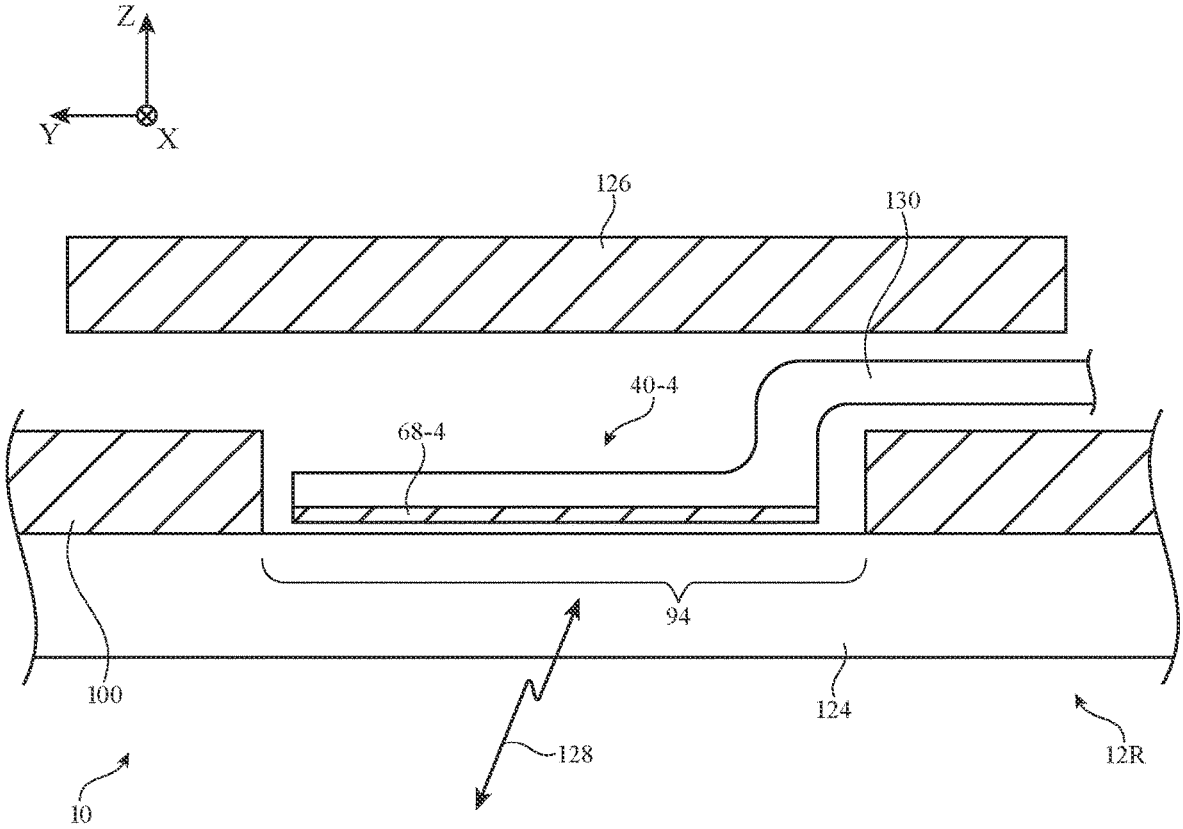
FIG. 7 is a side view showing how an illustrative antenna in an electronic device may be pressed against a rear housing wall of the electronic device in accordance with some embodiments.

FIG. 7 is a cross-sectional side view showing how antenna 40-4 may be pressed against a rear housing wall of device 10 for conveying UWB signals through the rear housing wall. As shown in FIG. 7, resonating element 68-4 of antenna 40-4 may be formed on flexible printed circuit substrate 130. Flexible printed circuit substrate 130 may form part of a larger flexible printed circuit structure that includes other flexible printed circuit substrates for mounting antennas 40-3, 40-5, and/or 40-6 of FIG. 6.

As shown in FIG. 7, ground structures 100 may form a portion of rear housing wall 12R (e.g., a conductive support plate or other conductive layer for rear housing wall 12R). Rear housing wall 12R may also include a dielectric cover layer such as dielectric cover layer 124 layered under ground structures 100. Flexible printed circuit substrate 130 may extend along ground structures 100. The portion of flexible printed circuit substrate 130 that includes antenna resonating element 68-4 may extend within opening 94 in ground structures 100 (e.g., antenna resonating element 68-4 may be aligned with opening 94). Antenna resonating element 68-4 and/or ground structures 100 may be adhered to dielectric cover layer 124 using adhesive if desired.

A conductive structure such as conductive structure 126 may be located (layered) over ground structures 100 and flexible printed circuit substrate 130. Conductive structure 126 may, for example, completely cover opening 94. Conductive structure 126 may be galvanically connected to ground structures 100 (e.g., using solder, welds, or other conductive adhesives), may be placed into contact with ground structures 100, or may be separated from and capacitively coupled to ground structures 100. Conductive structure 126 may include a conductive shielding layer (e.g., a sheet metal layer, conductive adhesive, conductive traces on a dielectric substrate, conductive portions of the housing for device 10, conductive foil, ferrite, or any other desired structures that block radio-frequency signals), conductive portions of components in device 10 such as conductive portions of a battery for device 10 or conductive portions of camera module 104 of FIG. 6, or any other desired conductive structures.

Antenna 40-4 may convey radio-frequency signals 128 (e.g., UWB signals) through opening 94 and dielectric cover layer 124 (e.g., through rear housing wall 12R and the rear face of device 10). Similar structures may also be used to configure antennas 40-5 and 40-6 of FIG. 6 to radiate through rear housing wall 12R. The example of FIG. 7 is merely illustrative. If desired, conductive structure 126 may be omitted. In another suitable arrangement, a dielectric substrate such as a dielectric shim may be placed on dielectric cover layer 124 within opening 94.

In one suitable arrangement that is sometimes described herein as an example, antennas 40-3, 40-4, 40-5, and 40-6 are each mounted to the same flexible printed circuit structure. The flexible printed circuit structure may include two or more flexible printed circuit substrates. The flexible printed circuit substrates in the flexible printed circuit structure may be mounted together (e.g., using a surface-mount technology (SMT) process). If desired, two or more of these antennas may be formed on the same flexible printed circuit substrate in the flexible printed circuit structure. In order to help conserve space within device 10, the flexible printed circuit structure may also include the radio-frequency transmission line paths 50 for antennas 40-1, 40-2, 40-3, 40-4, 40-5, and/or 40-6 (e.g., radio-frequency transmission line paths 50-1, 50-2, and 50-3 of FIG. 6 as well as radio-frequency transmission line paths for antennas 40-4, 40-5, and 40-6). Using the same flexible printed circuit structure to support antennas 40-3, 40-4, 40-5, and 40-6 and to route radio-frequency signals for antennas 40-1 and 40-2 may help to minimize space consumption within device 10 (e.g., thereby allowing more space for other device components) without significantly impacting antenna performance.

Figure 8:
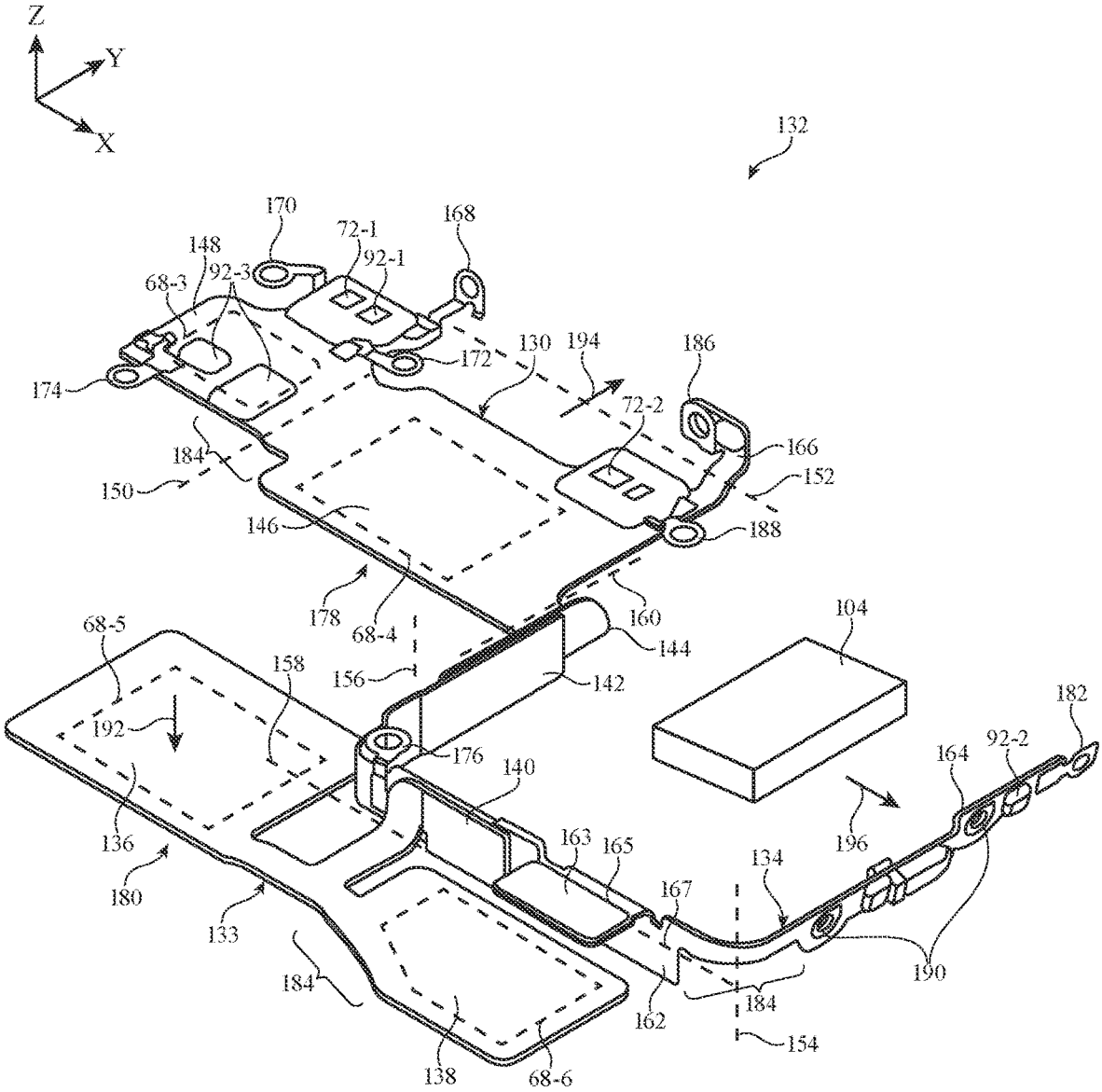
FIG. 8 is a perspective view of an illustrative flexible printed circuit structure that may be used to support and feed antennas of the type shown in FIGS. 6 and 7 in accordance with some embodiments.

FIG. 8 is a perspective view of an illustrative flexible printed circuit structure that may be used to support antennas 40-3, 40-4, 40-5, and 40-6 while also routing radio-frequency signals for antennas 40-1 and 40-2 of FIG. 6. As shown in FIG. 8, flexible printed circuit structure 132 may include two or more flexible printed circuit substrates such as flexible printed circuit substrates 130, 133, and 134 (sometimes referred to herein as flexible printed circuits 130, 133, and 134).

Flexible printed circuit structure 132 may include multiple bends (folds) along one or more axes. This may allow flexible printed circuit structure 132 to exhibit a meandering shape that accommodates other nearby components within device 10. Flexible printed circuit substrates 130, 133, and 134 may each be multilayer laminated structures having layers of conductive traces (e.g., layers of a conductive material such as copper and a dielectric material such as a resin that are laminated together without intervening adhesive). The multilayer laminated structures may, if desired, be folded or bent in multiple dimensions (e.g., two or three dimensions) and may maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures in each flexible printed circuit substrate may be batch laminated together (e.g., in a single pressing process) without adhesive (e.g., as opposed to performing multiple pressing processes to laminate multiple layers together with adhesive).

As shown in FIG. 8, flexible printed circuit substrate 130 may include portions (regions) such as portions 144, 146, 166, and 148. Portions 144, 166, and 148 may each extend from respective edges of portion 146 (e.g., portion 146 may be a central portion of flexible printed circuit substrate 130). Portion 144 may be bent (folded) about axis 160 with respect to portion 146 (e.g., an axis parallel to the Y-axis). Portion 166 may be bent (folded) about axis 152 with respect to portion 146 (e.g., an axis parallel to the X-axis). Portion 148 may be bent (folded) about axis 150 with respect to portion 146 (e.g., an axis parallel to the Y-axis). There may be multiple bends at or adjacent to axis 150 (e.g., so that portion 148 lies in a plane parallel to portion 146).

Axis 150 may be parallel to axis 160 or may extend at a non-zero angle with respect to axis 160. Axis 152 may extend at a non-zero angle with respect to (e.g., may be orthogonal to) axes 150 and/or 160. The bends in flexible printed circuit substrate 130 may be at any desired angles (e.g., portion 144 may lie in a plane perpendicular or non-parallel to portions 148, 146, and/or 166, portion 166 may lie in a plane perpendicular or non-parallel to portions 144, 146, and 148, etc.).

In other words, flexible printed circuit substrate 130 may include at least three bends (e.g., bends in at least two orthogonal directions) and portions lying in at least three non-parallel (e.g., orthogonal) planes. The example of FIG. 8 is merely illustrative and, in general, flexible printed circuit substrate 130 may include any desired number of bends about any desired number of axes at any desired orientations. Portions 146, 148, 166, and 144 may lie within any desired planes at any desired relative orientations. Portions 146, 148, 166, and 144 need not be confined to planes and may laterally extend along three-dimensional (e.g., curved) surfaces if desired.

Flexible printed circuit substrate 133 may include portions (regions) such as portions 140, 138, and 136. Portion 140 may be bent (folded) about axis 158 with respect to portions 136 and 138 (e.g., an axis parallel to the X-axis). Axis 158 may be parallel to axis 152 or may extend at a non-zero angle with respect to axis 152. Axis 158 may extend at a non-zero (e.g., perpendicular) angle with respect to axes 150 and/or 160. The bend(s) in flexible printed circuit substrate 133 may be at any desired angles (e.g., portion 140 may lie in a plane perpendicular or non-parallel to portions 136 and/or 138). Portion 138 may lie within the same plane as portion 136 or may lie in a plane parallel to portion 138. Portion 136 and/or portion 138 may lie in the same plane or in one or more planes parallel to portions 148 and/or 146 of flexible printed circuit substrate 130. Portion 140 may lie in a plane perpendicular or non-parallel to the plane of portion 144 and may lie in a plane parallel to portion 166 of flexible printed circuit substrate 130, for example.

In other words, flexible printed circuit substrate 133 may include at least one bend and portions lying in at least two non-parallel (e.g., orthogonal) planes. This example is merely illustrative and, in general, flexible printed circuit substrate 133 may include any desired number of bends about any desired number of axes at any desired orientations. Portions 136, 138, and 140 may lie within any desired planes at any desired relative orientations. Portions 136, 138, 140 need not be confined to planes and may laterally extend along three-dimensional (e.g., curved) surfaces if desired.

Flexible printed circuit substrate 134 may include portions (regions) such as portions 142, 162, 165, and 164. Portion 142 may be bent (folded) about (vertical) axis 156 with respect to portion 162 (e.g., an axis parallel to the Z-axis). Axis 156 may be non-parallel (e.g., perpendicular) to axes 152, 158, 150, 152, and 160 (sometimes referred to herein as horizontal or lateral axes 152, 158, 150, 152, and 160). Portion 164 may be bent (folded) about (vertical) axis 154 (e.g., an axis parallel to the Z-axis) with respect to portion 162. Axis 154 may be parallel to axis 156 or may extend at a non-parallel angle with respect to axis 156. Axis 154 may be non-parallel (e.g., perpendicular) to axes 152, 158, 150, 152, and 160. Portion 165 may be bent (folded) about (lateral) axis 167 (e.g., an axis parallel to the X-axis). Axis 167 may be parallel to axes 158 and 152 or may extend at a non-parallel angle with respect to axes 158 and 152. Axis 167 may be oriented at a non-parallel (e.g., perpendicular angle) with respect to axes 150 and/or 160.

The bend(s) in flexible printed circuit substrate 134 may be at any desired angles. For example, portion 164 may lie within a plane parallel to portion 142 and portion 144 of flexible printed circuit substrate 130 or may lie in a plane that is non-parallel with respect to portions 142 and 144. Portion 162 may lie within a plane that is non-parallel (e.g., perpendicular) with respect to portions 142 and 164. Portion 162 may, for example, lie within a plane parallel to portion 166 of flexible printed circuit substrate 130. Portion 165 may lie within a plane that is parallel to portions 146, 136, and/or 138 or may lie within a plane that is non-parallel with respect to portions 146, 136, and 138. Portion 165 may, for example, lie within a plane that is non-parallel (e.g., perpendicular) to portions 142, 162, and 164.

In other words, flexible printed circuit substrate 134 may include at least two bends and portions lying in at least three non-parallel (e.g., orthogonal) planes. The planes of portions 142, 162, and 164 may be perpendicular to portions 146, 148, 136, and 138, thereby allowing flexible printed circuit substrate 134 to wrap around electronic device components that occupy a significant amount of lateral area in device 10 (e.g., camera module 104). When provided in this arrangement, portion 164 may be laterally interposed between camera module 104 and segment 80 of peripheral conductive housing structures 12W (FIG. 6). This example is merely illustrative and, in general, flexible printed circuit substrate 134 may include any desired number of bends in about any desired number of axes at any desired orientations. Portions 142, 162, 165, and 164 may lie within any desired planes at any desired relative orientations. Portions 142, 162, 165, and 164 need not be confined to planes and may laterally extend along three-dimensional (e.g., curved) surfaces if desired.

Flexible printed circuit substrates 130, 133, and/or 134 in flexible printed circuit structure 132 may include one or more lateral cut-out regions 184 (e.g., cut outs in the lateral dimension of the respective flexible printed circuit substrates) that help flexible printed circuit structure 132 to fit within device 10 while accommodating other device components in the vicinity of flexible printed circuit structure 132.

Flexible printed circuit substrates 130 and 133 may each be attached (e.g., surface mounted) to flexible printed circuit substrate 134 to form flexible printed circuit structure 132. For example, portion 144 of flexible printed circuit substrate 130 may be attached (e.g., surface mounted) to portion 142 of flexible printed circuit substrate 134 whereas portion 140 of flexible printed circuit substrate 133 is attached (e.g., surface mounted) to portion 162 of flexible printed circuit substrate 134. There may be, for example, conductive contact pads on portions 144 and 142 that are soldered together and conductive contact pads on portions 140 and 162 that are soldered together during assembly of flexible printed circuit structure 132 (e.g., using an SMT process, a reflow process, a hot bar process, etc.). Once flexible printed circuit substrates 130, 133, and 134 have been attached together and folded, flexible printed circuit structure 132 may retain its shape upon assembly into device 10.

Antennas 40-3, 40-4, 40-5, and 40-6 of FIG. 6 may be formed on flexible printed circuit structure 132. For example, the antenna resonating element 68-4 of antenna 40-4 may be formed within portion 146 of flexible printed circuit substrate 130 whereas the antenna resonating element 68-5 of antenna 40-5 is formed within portion 136 and antenna resonating element 40-6 of antenna 40-6 is formed within portion 138 of flexible printed circuit substrate 133 (e.g., the triplet of UWB antennas for radiating through the rear housing wall of device 10 may be split between flexible printed circuit substrates 130 and 133 of flexible printed circuit structure 132). Similarly, the antenna resonating element 68-3 of antenna 40-3 may be formed within portion 148 of flexible printed circuit substrate 130. Antenna resonating elements 68-3 and 68-4 may be formed from one or more conductive layers on or embedded within the dielectric layers of flexible printed circuit substrate 130. Similarly, antenna resonating elements 68-5 and 68-6 may be formed from one or more conductive layers on or embedded within the dielectric layers of flexible printed circuit substrate 133. Antenna resonating elements 68-4, 68-5, and 68-6 may be pressed or biased (e.g., in the direction of arrow 192) against the rear housing wall for the device (e.g., dielectric cover layer 124 of FIG. 7).

A data port such as board-to-board (B2B) port 163 may be mounted to portion 165 of flexible printed circuit substrate 134. Port 163 may include data paths, radio-frequency paths, control paths, digital paths, and/or any other desired signal paths for conveying signals to and/or from flexible printed circuit structure 132. Port 163 may be coupled to transceiver circuitry (e.g., transceiver circuitry 60 on logic board 102 of FIG. 6) and/or control circuitry (e.g., control circuitry 28 of FIG. 2).

Radio-frequency transmission lines (e.g., striplines, microstrips, etc.) may be formed on flexible printed circuit substrate 134 for forming part of the radio-frequency transmission line paths (e.g., radio-frequency transmission line paths 50 of FIG. 6) that are used to feed antennas 40-1, 40-2, 40-3, 40-4, 40-5, and 40-6. Radio-frequency transmission lines (e.g., striplines, microstrips, etc.) may be formed on flexible printed circuit substrate 133 and may be coupled to the radio-frequency transmission lines on flexible printed circuit substrate 134 at portion 140 (e.g., portion 140 may include radio-frequency interfaces between the radio-frequency transmission lines on each substrate). The radio-frequency transmission lines on flexible printed circuit substrate 133 may be coupled to antenna resonating elements 68-5 and 68-6 (e.g., for feeding antennas 40-5 and 40-6 of FIG. 6).

Similarly, radio-frequency transmission lines (e.g., striplines, microstrips, etc.) may be formed on flexible printed circuit substrate 130 and may be coupled to the radio-frequency transmission lines on flexible printed circuit substrate 134 at portion 144 (e.g., portion 144 may include radio-frequency interfaces between the radio-frequency transmission lines on each substrate). The radio-frequency transmission lines on flexible printed circuit substrate 130 may be coupled to antenna resonating elements 68-3 and 68-4 (e.g., for feeding antennas 40-3 and 40-4 of FIG. 6) and may be coupled to antenna resonating element 68-1 for feeding antenna 40-1 of FIG. 6. In addition, one of the radio-frequency transmission lines on flexible printed circuit substrate 134 may be coupled to antenna resonating element 68-2 for feeding antenna 40-2 of FIG. 6 (e.g., without passing the transmission line path through flexible printed circuit substrates 130 or 133). There may also be digital data lines, control lines, or other lines on flexible printed circuit substrates 130, 133, and 134.

Tunable components and impedance matching circuitry may be mounted to flexible printed circuit structure 132. For example, tunable component 72-1 for antenna 40-1 of FIG. 6 may be mounted (e.g., surface-mounted) to portion 148 of flexible printed circuit substrate 130, whereas tunable component 72-2 for antenna 40-1 of FIG. 6 is mounted (e.g., surface-mounted) to portion 146 of flexible printed circuit substrate 130. Matching network 92-3 for antenna 40-3 and matching network 92-1 for antenna 40-1 of FIG. 6 may be mounted to portion 148 of flexible printed circuit substrate 130. Matching network 92-2 for antenna 40-2 of FIG. 6 may be mounted to portion 164 of flexible printed circuit substrate 134. Tunable component 72-1, tunable component 72-2, matching network 92-1, and/or matching network 92-2 may be controlled using control paths formed on flexible printed circuit substrates 130 and/or 134.

Ground traces may also be formed on flexible printed circuit substrates 130, 133, and/or 134. The ground traces may form part of the antenna ground (e.g., antenna ground 66 of FIGS. 4 and 5 and/or ground structures 100 of FIG. 6) for the antennas in device 10. The ground traces may also be used to isolate radio-frequency transmission lines and/or control paths on flexible printed circuit structure 132 from each other. The ground traces on flexible printed circuit substrate 130 may be coupled to the ground traces on flexible printed circuit substrate 134 (e.g., using solder) at portions 144 and 142. Similarly, the ground traces on flexible printed circuit substrate 133 may be coupled to the ground traces on flexible printed circuit substrate 134 (e.g., using solder) at portions 140 and 162. Ground traces on flexible printed circuit substrate 134 may be coupled to a ground pin or ground connector at port 163.

Flexible printed circuit structure 132 may include conductive interconnect structures used in forming terminals 86, 56-1, 88, 90, 56-2, 112, 58-1, 114, 116, and/or 58-2 of FIG. 6. For example, flexible printed circuit structure 132 may include conductive interconnect structures 174, 170, 168, 172, 186, 188, 176, 190, and 182. Conductive interconnect structures 174, 170, 168, 172, 186, and 188 may be formed on flexible printed circuit substrate 130 whereas conductive interconnect structures 176, 190, and 182 are formed on flexible printed circuit substrate 134.

Conductive interconnect structures 174, 170, 168, 172, 186, 188, 176, 190, and 182 may include, for example, solder, welds, conductive adhesive, conductive foam, conductive clips, conductive pins, conductive brackets, conductive gaskets, conductive springs, conductive traces on underlying dielectric substrates, integral portions of peripheral conductive housing structures 12W (e.g., an inwardly-extending ledge or lip of peripheral conductive housing structures 12W), conductive screws, conductive screw bosses, conductive washers or other conductive structures having openings for receiving conductive screws or pins, and/or any other desired conductive interconnect structures. In the example of FIG. 8, conductive interconnect structures 174, 170, 168, 172, 186, 188, 176, 190, and 182 are depicted as including conductive structures having openings for receiving conductive screws or pins for the sake of clarity. Conductive screws or pins that pass through the openings in conductive interconnect structures 174, 170, 168, 172, 186, 188, 176, 190, and 182 may electrically connect conductive paths on flexible printed circuit structure 132 to other conductive components in device 10 while also helping to mechanically attach (secure) flexible printed circuit structure 132 within device 10.

For example, conductive interconnect structure 174 may be used in forming the ground antenna feed terminal for antenna feed 48-3 of FIG. 6. Conductive interconnect structure 174 may electrically couple ground traces on flexible printed circuit substrate 130 to ground structures 100 of FIG. 6 while also helping to mechanically secure flexible printed circuit structure 132 to ground structures 100.

Similarly, conductive interconnect structure 170 may be used in forming terminal 86 (FIG. 6) of tunable component 72-1. Conductive interconnect structure 170 may electrically couple tunable component 72-1 to segment 76 of peripheral conductive housing structures 12W (FIG. 6) while also helping to mechanically secure flexible printed circuit structure 132 to peripheral conductive housing structures 12W. Conductive interconnect structure 172 may be used in forming terminal 112 (FIG. 6) of tunable component 72-1. Conductive interconnect structure 172 may electrically couple tunable component 72-1 to ground structures 100 (FIG. 6) while also helping to mechanically secure flexible printed circuit structure 132 to ground structures 100.

Conductive interconnect structures 168 and 186 (e.g., portion 166 of flexible printed circuit substrate 130) may be pressed or biased (e.g., in the direction of arrow 194) against the interior surface 122 of the segment 76 of peripheral conductive housing structures 12W (FIG. 6). Conductive interconnect structure 168 may be used in forming positive antenna feed terminal 56-1 for antenna 40-1 (FIG. 6). Conductive interconnect structure 168 may electrically couple antenna feed 48-1 for antenna 40-1 to segment 76 of peripheral conductive housing structures 12W (FIG. 6) while also helping to mechanically secure flexible printed circuit structure 132 to peripheral conductive housing structures 12W. If desired, conductive interconnect structure 172 may also or alternatively form ground antenna feed terminal 58-1 for antenna 40-1 (FIG. 6).

Conductive interconnect structure 186 may be used in forming terminal 88 (FIG. 6) of tunable component 72-2. Conductive interconnect structure 186 may electrically couple tunable component 72-2 to segment 76 of peripheral conductive housing structures 12W (FIG. 6) while also helping to mechanically secure flexible printed circuit structure 132 to peripheral conductive housing structures 12W. Conductive interconnect structure 188 may be used in forming terminal 114 of tunable component 72-2. Conductive interconnect structure 188 may electrically couple tunable component 72-2 to ground structures 100 (FIG. 6) while also helping to mechanically secure flexible printed circuit structure 132 to ground structures 100.

Conductive interconnect structure 176 may be used to couple ground traces on flexible printed circuit substrate 134 to conductive portions of other components in device 10 (e.g., camera module 104), to ground structures 100 of FIG. 6, and/or to any other desired components. Conductive interconnect structure 176 may help to mechanically secure flexible printed circuit structure 132 in place within device 10.

Conductive interconnect structures 190 and 182 (e.g., portion 164 of flexible printed circuit substrate 134) may be pressed or biased (e.g., in the direction of arrow 196) against the interior surface 120 of segment 80 and/or the interior surface 118 of segment 82 of peripheral conductive housing structures 12W (FIG. 6). Conductive interconnect structure 182 may be used in forming positive antenna feed terminal 56-2 for antenna 40-2 (FIG. 6). Conductive interconnect structure 182 may electrically couple antenna feed 48-2 for antenna 40-2 to segment 80 of peripheral conductive housing structures 12W (FIG. 6) while also helping to mechanically secure flexible printed circuit structure 132 to peripheral conductive housing structures 12W. Conductive interconnect structures 190 may be used in coupling ground traces on flexible printed circuit substrate 134 to ground structures 100, segment 80, and/or segment 82 of peripheral conductive housing structures 12W, and/or in forming ground antenna feed terminal 58-2 for antenna 40-2 (FIG. 6). Conductive interconnect structures 190 may also help to mechanically secure flexible printed circuit structure 132 to peripheral conductive housing structures 12W and/or ground structures 100.

In this way, flexible printed circuit structure 132 may be used to form the antenna resonating elements for antennas 40-3, 40-4, 40-5, and 40-6 while also forming the radio-frequency transmission line paths for antennas 40-1, 40-2, 40-3, 40-4, 40-5, and 40-6 (FIG. 8). For example, radio-frequency transmission line path 50-1 of FIG. 6 may include a first radio-frequency transmission line in flexible printed circuit substrate 130 extending from conductive interconnect structures 168 and 172 to a corresponding radio-frequency contact pad in portion 144. The radio-frequency transmission line path may include a second radio-frequency transmission line in flexible printed circuit substrate 134 extending from a radio-frequency contact pad in portion 142 (e.g., a contact pad soldered to the radio-frequency contact pad in portion 144) to port 163.

Similarly, radio-frequency transmission line path 50-2 of FIG. 6 may include a radio-frequency transmission line in flexible printed circuit substrate 134 that extends from conductive interconnect structures 182 and 190 to port 163. In addition, radio-frequency transmission line path 50-3 of FIG. 8 may include a first radio-frequency transmission line path in flexible printed circuit substrate 130 that extends from antenna resonating element 68-3 to a corresponding radio-frequency contact pad in portion 144. The radio-frequency transmission line path may include a second radio-frequency transmission line in flexible printed circuit substrate 134 extending from a radio-frequency contact pad in portion 142 to port 163. Radio-frequency transmission lines for antenna 40-4 may be formed in flexible printed circuit substrates 130 and 134. Radio-frequency transmission lines for antennas 40-5 and 40-6 may be formed in flexible printed circuit substrates 133 and 134. The example of FIG. 8 is merely illustrative and, if desired, flexible printed circuit structure 132 may include only two flexible printed circuit substrates or more than three flexible printed circuit substrates. Flexible printed circuit structure 132 may include any desired folds or bends. Flexible printed circuit substrates 130, 133, and 134 may have any desired lateral and/or three-dimensional shapes.

The modular folded structure of flexible printed circuit structure 132 may allow antennas 40-3, 40-4, 40-5, and 40-6 to be mounted and fed and to allow antennas 40-1 and 40-2 (FIG. 6) to be fed while occupying a minimum amount of space within device 10 and while exhibiting satisfactory radio-frequency performance. Flexible printed circuit structure 132 may, for example, be folded or wrapped around and/or placed above and/or below other components in device 10 (e.g., camera module 104). If desired, flexible printed circuit structure 132 may also exhibit different thicknesses to help accommodate the presence of other components adjacent to flexible printed circuit structure 132. The modular structure of flexible printed circuit structure 132 may allow flexible printed circuit structure 132 to be formed with many different thicknesses despite limitations associated with flexible printed circuit substrate manufacture.

Figure 9:
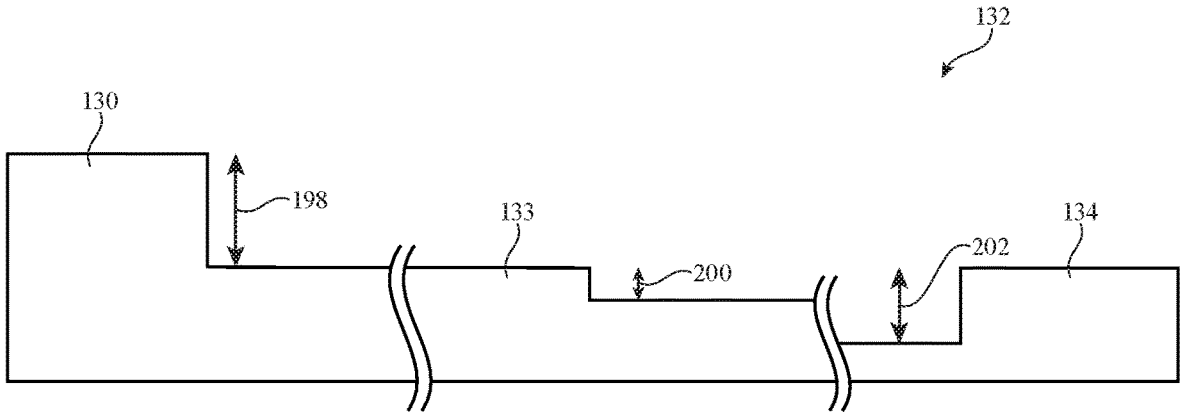
FIG. 9 is a cross sectional side view showing how an illustrative flexible printed circuit structure may include different flexible printed circuit substrates with different thicknesses in accordance with some embodiments.

FIG. 9 is a side view of flexible printed circuit structure 132 showing how flexible printed circuit structure 132 may have different thicknesses across its lateral area. In the example of FIG. 9, flexible printed circuit structure 132 has been flattened (or has not yet been folded or bent) for the sake of clarity.

As shown in FIG. 9, flexible printed circuit substrate 130 may include thinner portions and thicker portions that are thicker than the thinner portions by step size 198. Flexible printed circuit substrate 133 may include thinner portions and thicker portions that are thicker than the thinner portions by step size 200. Flexible printed circuit substrate 134 may include thinner portions and thicker portions that are thicker than the thinner portions by step size 202. Step sizes 198, 200, and 202 may be different from each other. The thinner portions of flexible printed circuit substrates 130, 133, and 134 may be different thicknesses relative to each other and the thicker portions of flexible printed circuit substrates 130, 133, and 134 may be different thicknesses relative to each other. This example is merely illustrative. Each flexible printed circuit substrate 130, 133, and 134 may include multiple thinner and thicker portions, may include portions with more than two thicknesses, may include multiple step sizes, etc. The thinner portions may reduce the amount of space occupied by flexible printed circuit structure 132 to accommodate the presence of other components in the vicinity of flexible printed circuit structure 132.

The thicker portions of flexible printed circuit structure 132 may be formed by adding additional layers of flexible printed circuit substrate material that are not included on the thinner portions of flexible printed circuit structure 132. In practice, there are limits to the step sizes and thicknesses available during manufacture of any given flexible printed circuit substrate (e.g., the step sizes may each be less than about 100-120 microns). By separately manufacturing flexible printed circuit substrates 130, 133, and 134 and then assembling the flexible printed circuit substrates to form flexible printed circuit structure 132, flexible printed circuit structure 132 may exhibit a greater variety of different thicknesses and step sizes (e.g., to provide greater flexibility in accommodating other components in device 10) than in scenarios where flexible printed circuit structure 132 is formed from only a single flexible printed circuit substrate.

Figure 10:
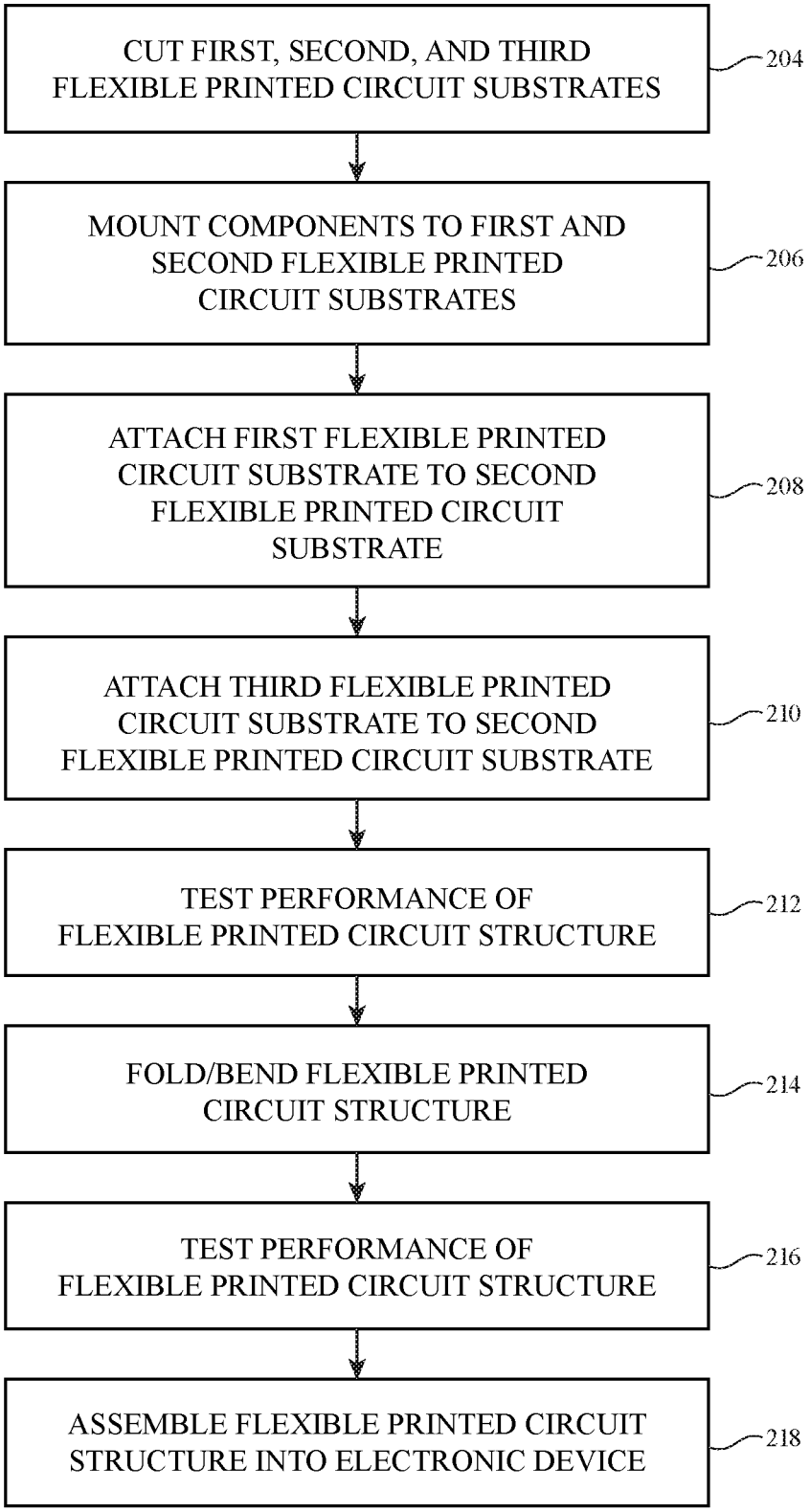
FIG. 10 is a flow chart of illustrative steps that may be performed in manufacturing an electronic device having a flexible printed circuit structure of the type shown in FIGS. 8 and 9 in accordance with some embodiments.

FIG. 10 is a flow chart of illustrative steps that may be performed in assembling flexible printed circuit structure 132 within device 10. The steps of FIG. 10 may, for example, be performed in a manufacturing or assembly system having manufacturing equipment (e.g., prior to device 10 being provided to an end user).

At step 204, the manufacturing equipment may manufacture flexible printed circuit substrates 130, 133, and 134 (e.g., with thinner and thicker regions and different thickness step sizes such as step sizes 198, 200, and 202 of FIG. 9). Flexible printed circuit substrates 130, 133, and 134 may be manufactured in a flat (planar) configuration (e.g., from a planar sheet of flexible printed circuit material). Conductive traces may be patterned on the flexible printed circuit substrates (e.g., to form radio-frequency transmission lines, data paths, control paths, digital paths, ground traces, etc.). The manufacturing equipment may cut the flexible printed circuit substrates into a desired lateral shape (e.g., to define the lateral areas of the flexible printed circuit substrates and to include cut-out regions 184 of FIG. 8).

At step 206, the manufacturing equipment may mount components to flexible printed circuit substrates 130 and 134 (e.g., using an SMT process, solder, etc.). For example, the manufacturing equipment may mount tunable components 72-1 and 72-2 and matching network 92-1 and 92-3 to flexible printed circuit substrate 130 (FIG. 8). The manufacturing equipment may also mount matching network 92-2 to flexible printed circuit substrate 134 (FIG. 8).

At step 208, the manufacturing equipment may attach flexible printed substrate 130 to flexible printed circuit substrate 134. For example, the manufacturing equipment may use solder, an SMT process, a reflow process, and/or other processes, to attach portion 144 of flexible printed circuit substrate 130 to portion 142 of flexible printed circuit substrate 134.

At step 210, the manufacturing equipment (e.g., in a bonding line) may attach flexible printed substrate 133 to flexible printed circuit substrate 134. For example, the manufacturing equipment may use solder, an SMT process, a reflow process, and/or other processes, to attach portion 140 of flexible printed circuit substrate 133 to portion 162 of flexible printed circuit substrate 134 (e.g., the manufacturing equipment may treat flexible printed circuit substrate 133 as an SMT component to be mounted to flexible printed circuit substrate 134).

At optional step 212, the manufacturing system or a separate testing system may test the electromagnetic (e.g., radio-frequency) and/or mechanical performance of flexible printed circuit structure 132. Step 212 may be omitted if desired.

At step 214, the manufacturing system may fold (bend) flexible printed circuit substrates 130, 133, and/or 134 in flexible printed circuit structure 132 (e.g., about at least axes 150, 152, 160, 158, 167, and/or 154 of FIG. 8). Flexible printed circuit structure 132 may hold its three-dimensional shape after folding.

At optional step 216, the manufacturing system or a separate testing system may test the electromagnetic (e.g., radio-frequency) and/or mechanical performance of flexible printed circuit structure 132. Step 216 may be omitted if desired.

At step 218, flexible printed circuit structure 132 may be assembled into device 10. Flexible printed circuit structure 132 may be mechanically secured to peripheral conductive housing structures 12W and/or ground structures 100 (FIG. 6). For example, conductive interconnect structures 170, 168, 186, 182, and 190 of FIG. 8 may be attached to peripheral conductive housing structures 12W (e.g., using conductive screws, solder, welds, conductive adhesive, etc.) and conductive interconnect structures 174, 172, 188, and 176 may be attached to ground structures 100 (e.g., using conductive screws, solder, welds, conductive adhesive, etc.). Radio-frequency signals may then be conveyed between transceiver circuitry 60 and antennas 40-1, 40-2, 40-3, 40-4, 40-5, and 40-6 (FIG. 6) through flexible printed circuit structure 132.

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:

peripheral conductive housing structures;

a first antenna having a resonating element arm formed from a segment of the peripheral conductive structures and having an antenna feed coupled to the resonating element arm;

a flexible printed circuit substrate coupled to the peripheral conductive housing structures;

a radio-frequency transmission line on the flexible printed circuit substrate and coupled to the antenna feed, the radio-frequency transmission line being configured to convey radio-frequency signals for the first antenna;

a second antenna on the flexible printed circuit substrate, wherein the second antenna is configured to radiate in a cellular ultra-high band; and a third antenna on the flexible printed circuit substrate, wherein the third antenna is configured to radiate in an ultra-wideband communications band.

2. The electronic device defined in claim 1, further comprising a first additional flexible printed circuit substrate soldered to the flexible printed circuit substrate.

3. The electronic device defined in claim 2, further comprising:

a fourth antenna having an additional resonating element arm formed from an additional segment of the peripheral conductive housing structures, the additional segment of the peripheral conductive housing structures being separated from the segment of the peripheral conductive housing structures by a dielectric-filled gap, and the fourth antenna having an additional antenna feed coupled to the additional resonating element arm; and an additional radio-frequency transmission line on the first additional flexible printed circuit substrate and coupled to the additional antenna feed, wherein the additional radio-frequency transmission line is configured to convey radio-frequency signals for the fourth antenna.

4. The electronic device defined in claim 3, further comprising:

a second additional flexible printed circuit substrate soldered to the first additional flexible printed circuit substrate;

a fifth antenna on the second additional flexible printed circuit substrate and configured to radiate in the ultra-wideband communications band; and a sixth antenna on the second additional flexible printed circuit substrate and configured to radiate in the ultra-wideband communications band.

5. The electronic device defined in claim 2, further comprising:

a second additional flexible printed circuit substrate soldered to the first additional flexible printed circuit substrate.

6. The electronic device defined in claim 5, further comprising:

a fourth antenna on the second additional flexible printed circuit substrate and configured to radiate in the ultra-wideband communications band; and a fifth antenna on the second additional flexible printed circuit substrate and configured to radiate in the ultra-wideband communications band.

7. The electronic device defined in claim 5, wherein the flexible printed circuit substrate comprises a bend about a first axis, the second additional flexible printed circuit substrate comprises a bend about a second axis, and the first additional flexible printed circuit comprises a bend about a third axis that is perpendicular to the first and second axes.

8. The electronic device defined in claim 5, wherein the flexible printed circuit substrate comprises at least three bends, the first additional flexible printed circuit substrate comprises at least two bends, and the second additional flexible printed circuit substrate comprises at least one bend.

9. The electronic device defined in claim 1, further comprising:

a tunable component surface-mounted to the flexible printed circuit substrate and configured to tune the first antenna; and impedance matching circuitry surface-mounted to the flexible printed circuit substrate and configured to tune the second antenna.

10. The electronic device defined in claim 1, wherein the ultra-wideband communications band comprises a frequency between 6250 MHz and 8250 MHz, the cellular ultra-high band comprising a frequency between 3400 MHz and 3700 MHz.

11. A flexible printed circuit structure configured to convey radio-frequency signals for an antenna external to the flexible printed circuit structure, the flexible printed circuit structure comprising:

a first flexible printed circuit substrate having first and second antennas;

a second flexible printed circuit substrate surface-mounted to the first flexible printed circuit substrate;

a radio-frequency transmission line path on the first and second flexible printed circuit substrates that is configured to convey radio-frequency signals for the antenna external to the flexible printed circuit substrate;

a third flexible printed circuit substrate surface-mounted to the second flexible printed circuit substrate; and a third antenna on the third flexible printed circuit substrate.

12. The flexible printed circuit structure defined in claim 11, wherein the first flexible printed circuit substrate comprises a first thinner portion and a first thicker portion that is thicker than the first thinner portion by a first step size and the second flexible printed circuit substrate comprises a second thinner portion and a second thicker portion that is thicker than the second thinner portion by a second step size, the second step size being different from the first step size.

13. The flexible printed circuit structure defined in claim 11, further comprising a fourth antenna on the third flexible printed circuit substrate, wherein the first and second flexible printed circuit substrates have first additional radio-frequency transmission line paths that convey radio-frequency signals for the first and second antennas, and the second and third flexible printed circuit substrates have second additional radio-frequency transmission line paths that convey radio-frequency signals for the third and fourth antennas.

14. The flexible printed circuit structure defined in claim 13, wherein the second, third, and fourth antennas are configured to form a triplet of antennas that radiate in an ultra-wideband communications band.

15. The flexible printed circuit structure defined in claim 14, wherein the first antenna is configured to receive radio-frequency signals in the ultra-wideband communications band and is configured to transmit radio-frequency signals in a non-ultra-wideband communications band.

16. The flexible printed circuit structure defined in claim 11, wherein the first flexible printed circuit substrate comprises a first thinner portion and a first thicker portion that is thicker than the first thinner portion by a first step size, the second flexible printed circuit substrate comprises a second thinner portion and a second thicker portion that is thicker than the second thinner portion by a second step size, the third flexible printed circuit substrate comprises a third thinner portion and a third thicker portion that is thicker than the third thinner portion by a third step size, the second step size is different from the first step size, and the third step size is different from the first and second step sizes.

17. The flexible printed circuit structure defined in claim 11, wherein the first flexible printed circuit substrate comprises a first bend about a first axis and a second bend about a second axis non-parallel to the first axis, the second flexible printed circuit substrate comprises a third bend about a third axis orthogonal to the first and second axes and a fourth bend about a fourth axis parallel to the third axis, and the third flexible printed circuit substrate comprises a fifth bend about a fifth axis parallel to the first axis.

18. An electronic device comprising:

peripheral conductive housing structures having a dielectric-filled gap that divides the peripheral conductive housing structures into first and second segments;

a first antenna having a first resonating element arm formed from the first segment;

a second antenna having a second resonating element arm formed from the second segment;

a first flexible printed circuit substrate coupled to the first segment and configured to convey radio-frequency signals for the first antenna;

a third antenna on a portion of the first flexible printed circuit substrate; and a second flexible printed circuit substrate coupled to the second segment and configured to convey radio-frequency signals for the second antenna, wherein the second flexible printed circuit substrate has a first portion that is soldered to the first flexible printed circuit substrate, a second portion that is attached to the second segment, and a third portion that extends between the first and second portions, the first, second, and third portions being non-parallel with respect to the portion of the first flexible printed circuit board having the third antenna.

19. The electronic device defined in claim 18, further comprising:

a camera module, wherein the camera module is interposed between the first and second portions of the second flexible printed circuit board, the second portion being interposed between the camera module and the second segment.

20. The electronic device defined in claim 19, further comprising:

a third flexible printed circuit substrate soldered to the third portion of the second flexible printed circuit substrate;

a fourth antenna on the third flexible printed circuit substrate; and a board-to-board connector on the second flexible printed circuit substrate.

* * * * *